US009097033B2

(12) United States Patent
Margevicius et al.

(10) Patent No.: US 9,097,033 B2
(45) Date of Patent: Aug. 4, 2015

(54) TOWER LIFTING STAND SYSTEM

(75) Inventors: Joseph R. Margevicius, Detroit, MI (US); Marvin G. Wasmund, St. Clair, IL (US); Andrew S. Oliver, Plainfield, IL (US)

(73) Assignee: Walbridge Equipment Installation LLC, Aurora, IL (US)

( * ) Notice: Subject to any disclaimer, the term of this patent is extended or adjusted under 35 U.S.C. 154(b) by 0 days.

(21) Appl. No.: 13/544,585

(22) Filed: Jul. 9, 2012

(65) Prior Publication Data

US 2013/0008097 A1 Jan. 10, 2013

Related U.S. Application Data

(60) Provisional application No. 61/505,703, filed on Jul. 8, 2011.

(51) Int. Cl.
*E04H 12/34* (2006.01)

(52) U.S. Cl.
CPC ..... *E04H 12/344* (2013.01); *E04H 12/34* (2013.01)

(58) Field of Classification Search
CPC ..... E04H 12/344; E04H 12/34
USPC ..... 52/123.1, 122.1, 126.1, 514
See application file for complete search history.

(56) References Cited

U.S. PATENT DOCUMENTS

| | | | | | |
|---|---|---|---|---|---|
| 2,336,432 | A * | 12/1943 | Wilson | 182/69.4 |
| 2,530,807 | A * | 11/1950 | Campbell | 254/92 |
| 4,231,200 | A * | 11/1980 | Henderson | 52/111 |
| 4,327,534 | A * | 5/1982 | Mastalski et al. | 52/122.1 |
| 4,447,997 | A * | 5/1984 | Delgado | 52/120 |
| 4,621,972 | A * | 11/1986 | Grotte | 414/477 |
| 4,697,959 | A * | 10/1987 | Kinnan | 405/232 |
| 5,337,469 | A * | 8/1994 | Richey | 29/402.12 |
| 6,115,988 | A * | 9/2000 | Reisdorff | 52/741.14 |
| 6,151,860 | A * | 11/2000 | Reisdorff | 52/651.02 |
| 6,301,841 | B1 * | 10/2001 | Rhebergen et al. | 52/123.1 |
| 6,782,667 | B2 * | 8/2004 | Henderson | 52/116 |
| 6,886,661 | B1 * | 5/2005 | Battenberg | 182/77 |
| 6,955,025 | B2 * | 10/2005 | Dehlsen et al. | 52/745.17 |
| 7,237,312 | B2 * | 7/2007 | Enns | 29/468 |
| 7,814,725 | B2 * | 10/2010 | Kwon | 52/745.17 |
| 8,042,306 | B2 * | 10/2011 | Jolly | 52/123.1 |
| 2013/0008097 | A1 * | 1/2013 | Margevicius et al. | 52/123.1 |

* cited by examiner

*Primary Examiner* — Andrew J Triggs
(74) *Attorney, Agent, or Firm* — Fishman Stewart Yamaguchi PLLC

(57) ABSTRACT

A tower lifting stand system and method is provided for use in lifting a large structure such as a transmission tower that is used in our power grid. A lifting mechanism engages a structure connected to the tower which work together to lift the tower once the lifting mechanism has been activated. Once the tower is lifted, a vertical extension section can be installed thus lifting the tower, and its associated power lines, vertically a predetermined distance.

19 Claims, 22 Drawing Sheets

TOWER LIFTING STAND SYSTEM

CROSS-REFERENCE TO RELATED APPLICATIONS

This application claims priority to U.S. provisional application Ser. No. 61/505,703 filed on Jul. 8, 2011, the contents of which are incorporated by reference in their entirety.

BACKGROUND AND SUMMARY

Transmission towers are used to provide a mechanism for carrying high voltage power lines throughout an electrical power grid. Typical transmission towers are aligned in a predetermined path and are placed within a power grid in accordance with the needs and demands of a population geographically located within the grid. Over fifty years ago it became customary to erect transmission towers across our country, which in large part have gone unattended and without much maintenance.

Transmission lines are typically secured to the upper portion of transmission towers using insulators, which allow the lines to be stretched from tower to tower. The transmission lines extend for miles and they drape from transmission tower to tower. Over time the transmission lines have become stressed due to increased exposure to environmental conditions and largely because the power companies have increased the voltage being transmitted through the grid system. This increase in voltage is due to increased consumer demand due to population growth and industry growth over the last century. Larger agricultural equipment has contributed to further decreased clearances and fatalities have resulted due to insufficient ground clearance.

One of the problems with transmission lines as they age is that they have a tendency of expanding and contracting, which over the years has caused them to generally stretch and increase in overall length since they have a tendency to expand more than they contract. When the length of the line increases, that extra length has to be absorbed within the power grid system somehow. The end result is that the newly extended length of lines is accumulated between each transmission tower in the form of increased line sag. Over time line sag can amount to several feet of vertical distance in drop of the line towards the earth. In some instances, it has been known that the transmission lines sag so severely that they physically interfere with the environment below where the transmission lines are hanging. It is desirable to eliminate this concern for safety reasons as well as to comply with governmental regulations. Accordingly, it would be desirable to provide a system and method of increasing the distance between the ground and sagging transmission lines that are becoming abundant in our power grid.

One method for resolving the aforementioned problem is to deliver a large crane to a job site where the transmission tower resides and use the crane to physically lift the tower up in the air so as to provide room under the previously existing transmission tower. Once the tower is raised, a vertical extension section can then be permanently installed. This process raises up the tower which in turn lifts up the transmission lines so that they are off of the ground. The problem, however, with this approach is that cranes are very expensive to operate on an hourly basis, which makes them cost prohibitive to use exclusively for maintaining the thousands of towers that are in our power grid. Further, because the type of crane that is needed to do this job is so large, the installation and setup process requires substantial resources and manpower to even stage the crane at the job site. This is because large lift cranes often require special beds to be laid down on the ground in advance of the crane being delivered to the job site which often is in rural areas having limited accessibility. The effort alone to get a large crane to an individual tower location is very labor intensive and often cost prohibitive. Thus, it would be preferred to avoid the use of cranes for this transmission tower maintenance work. A scheduled line outage is required for crane operations to be performed safely—this is organizationally challenging and costly to the utility.

One exemplary aspect is to provide a new method of installing an extension or vertical riser section to the base of a previously existing transmission tower. In one illustrative approach, the method includes placing a portable modular lifting stand under the transmission tower and stabilizing the stand relative to the ground. A stand head is then secured to a section of the tower. The lifting stand has a lifting mechanism that engages the stand head. The transmission tower is now ready to be raised a sufficient height so as to lift the transmission tower a predetermined distance. Once the tower is lifted, an operator can locate at least one tower vertical extension section into place. The vertical extension section is then secured to the previous transmission tower. The tower now has been modified by being lifted to a predetermined distance, which in turn raises the transmission lines further away from ground level. Once the tower has been modified, the stand head can be disconnected from the portable modular lifting stand which can now be moved away from the job site. All equipment can be installed and operated within the safe clearance zone without need for scheduled transmission line outage. Additionally the equipment sits within the grounded cage of the tower.

Another illustrative aspect of the present invention includes providing a modular mobile lifting stand comprising a trailer, a stand that is operable to be transported by the trailer, a lift mechanism that is movable relative to the stand, and a stand head that can be secured to a transmission tower. Other aspects of the present invention will become apparent and are set forth below.

DETAILED DESCRIPTION OF THE DRAWINGS

While the claims are not limited to the specific illustrations, an appreciation of various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
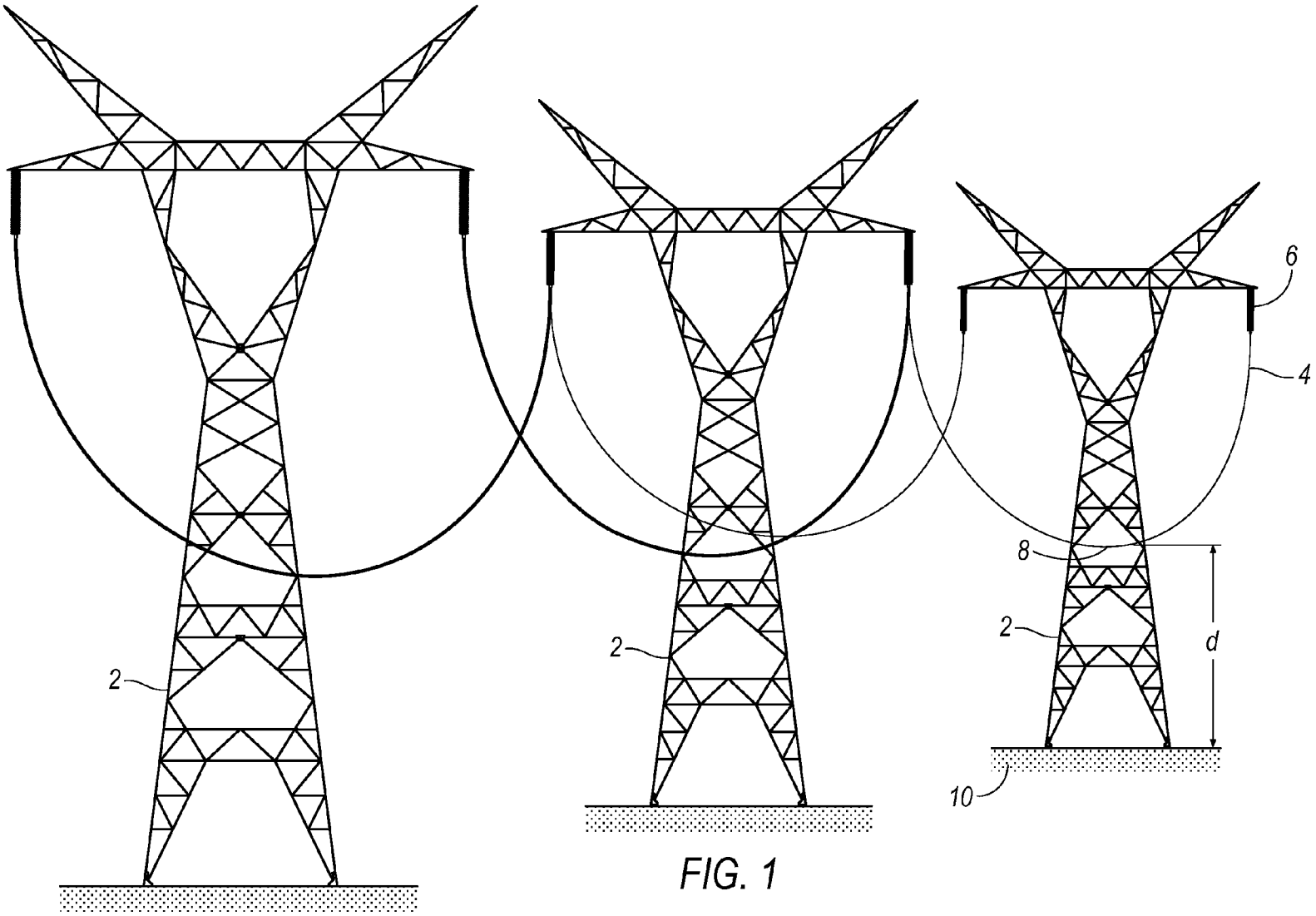
FIG. 1 illustrates aging transmission towers and transmission lines.

FIG. 1 illustrates typical transmission lines that one might find in the power grid that is used in our country. High voltage transmission towers 2 traverse our countryside and are connected by transmission lines 4. Insulators 6 suspend the lines 4 from the towers 2. Over time, the distance d between the lowermost point 8 of the power line 4 and the ground 10 will change. FIG. 1 illustrates transmission lines 4 that have aged and are in need of repair.

Figure 2:
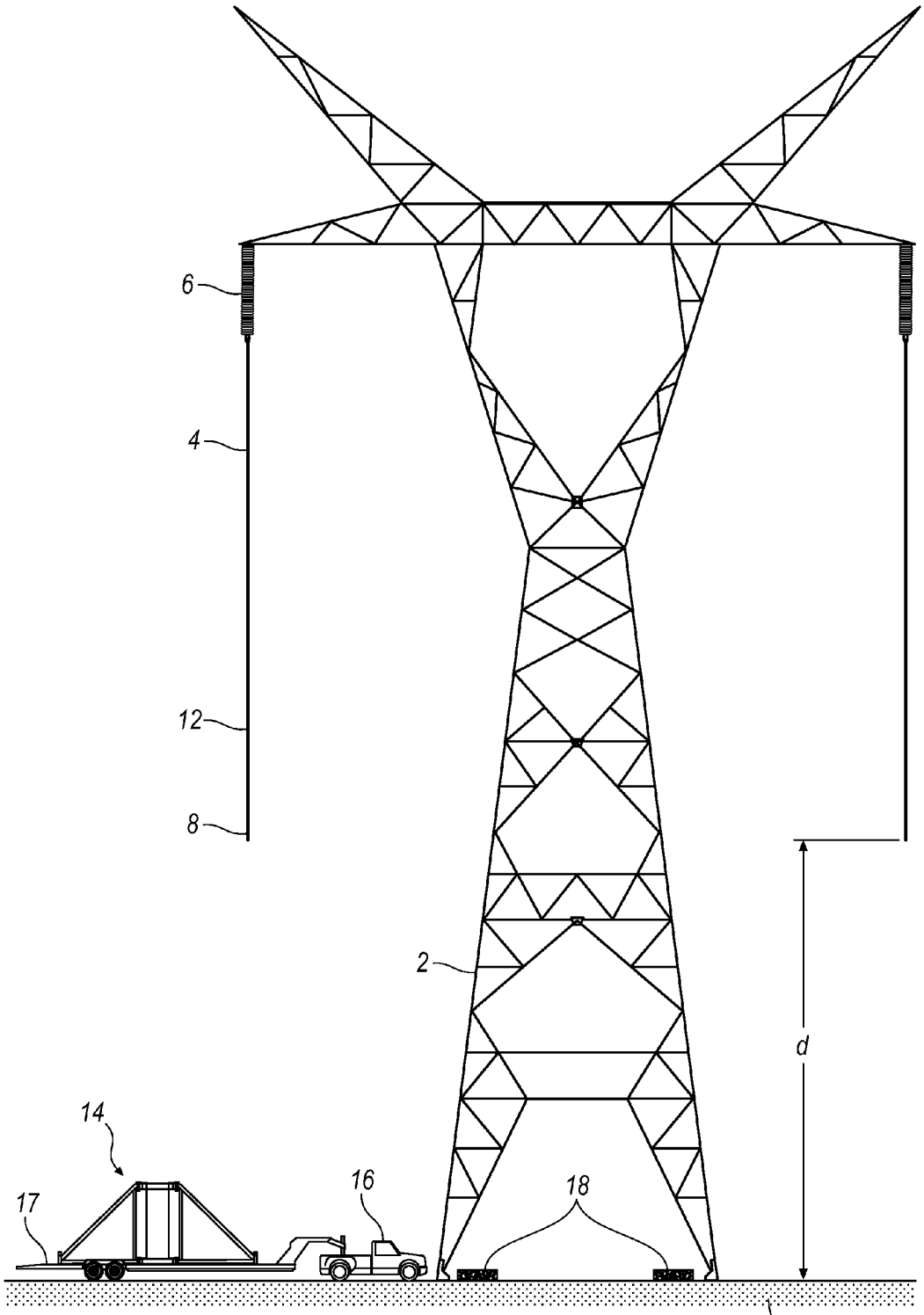
FIG. 2 illustrates a transmission tower that needs to be serviced, and showing the transmission lines low to the ground.

FIG. 2 illustrates an apparatus and method that can be used to maintain a tower 2 that has transmission lines 4 that have sagged to an unacceptable lower point 8. To address this problem, a novel portable lifting stand system 14 has been delivered to a job site. A vehicle 16 pulls a trailer 17 in place where it can be staged for a maintenance project. The system 14 is transported on the trailer 17. Of course, system 14 could be incorporated into vehicle 16 so the illustrative approach is merely exemplary. The tower is shown with sagging 8 power lines 4 that are offset from the ground 10 a vertical distance of d. There is sufficient clearance under the tower 2 to allow a vehicle 16 and the tower lifting stand system 14 to drive underneath the tower 2 and to be located to an operating position. Pads 18 are positioned on the ground 10 at predetermined positions so as to provide landing pads for the outriggers of the lifting stand system 14 to rest upon. It will be appreciated that the lifting system 14 can be used when lifting a tower 2, and other large structures and objects. Thus, while the description below is exemplary of how such a system could be used in tower maintenance applications, it will be appreciate that such a system could be used for other projects where lifting and maintaining large objects is desired.

Figure 3:
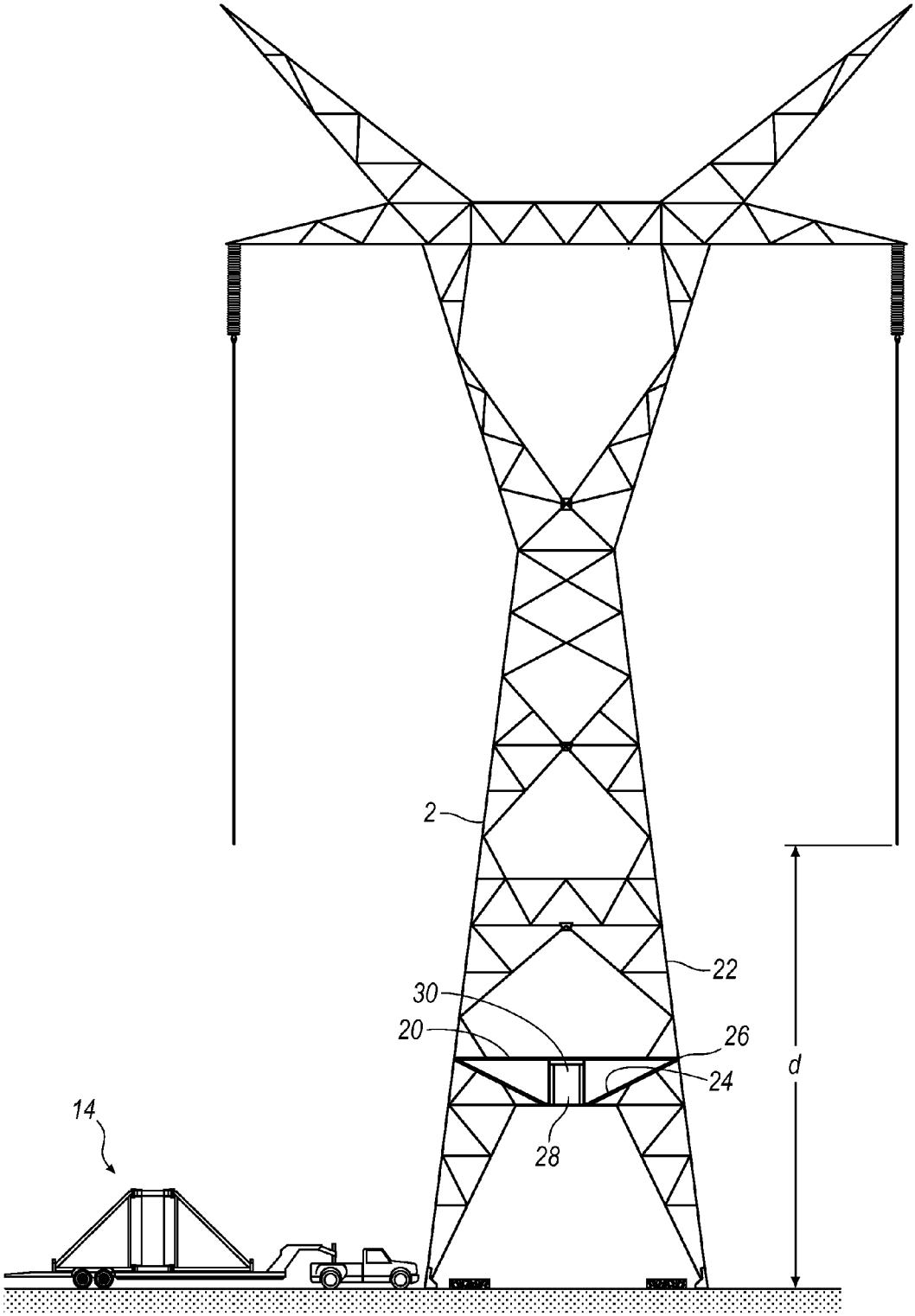
FIG. 3 illustrates a transmission tower with a stand head installed.

With reference to FIG. 3, a head stand 20 is shown secured to a tower 2 at its lower portion 22. The head stand 20 is made of structural steel and includes a frame 24 that is secured at its four corners to the tower 2 by a tower clamping mechanism 26. The details of the tower clamping mechanism 26 are further depicted in FIG. 10. The head stand 20 further includes a receiver 28 that is operable to receive the telescoping outermost end portion of a telescoping member, or the like. The head stand 20 further includes a head stand locking system 30 which is operable to secure an upwardly extending telescoping portion to the frame 24 of the head stand 20.

Figure 4:
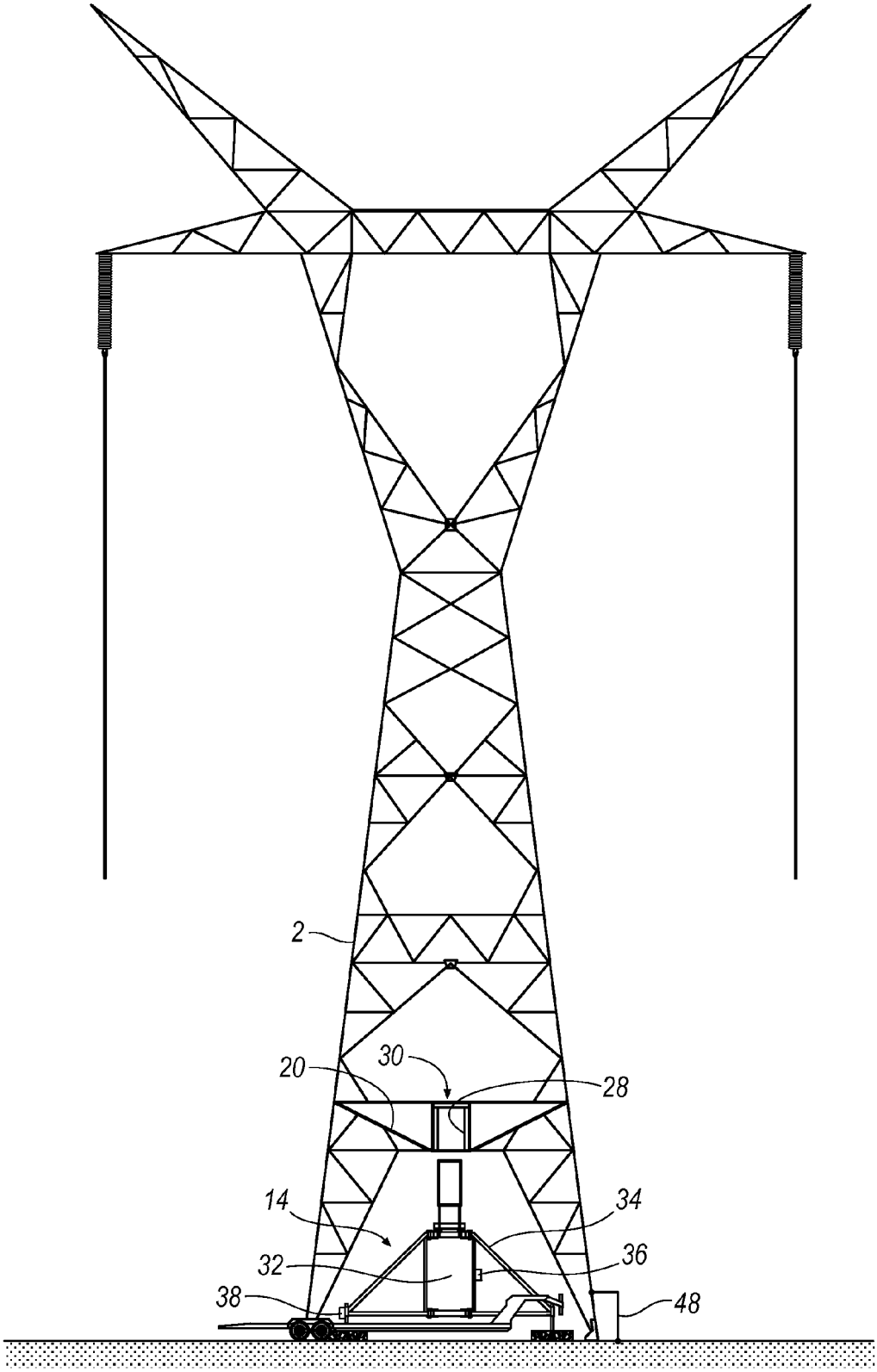
FIG. 4 illustrates a transmission tower with a lifting stand system in place and ready for operation.

FIG. 4 illustrates the tower lifting stand 14 advanced to its operating position underneath the tower 2. The vehicle 16 has been removed from the location so as to provide a better working environment. With reference to both FIGS. 4 and 5, the tower lifting stand system 14 includes a hydraulic jack 32, a plurality of outriggers 34, a positioning leveling indicator 36, and a leveling system 38. The hydraulic jack 32 includes an outer body 40 and a plurality of telescoping sections 42, 44 and 46. Each section is operable to be hydraulically actuated by the hydraulic jack 32 and exert an upward force on the tower 2. The uppermost section 46 is operable to be received within the receiver 28 of the head stand 20 such that they engage one another and can be locked via a head stand locking system 30. The head stand locking system 30 can be remotely controlled with a remote device 58 by an operator on the ground so as to provide remote engagement and disengagement of the telescoping section 46 from the head stand 20 as discussed in more detail before with respect to FIG. 6B. This avoids the necessity of a worker having to climb the tower 2 and manually secure together the hydraulic jack 32 to the head stand 20.

A ground wire or system 48 extends from the lower portion 22 of the tower to the ground 10. It will be appreciated that other grounding mechanisms 48 could be utilized to ensure safety of the workers who are maintaining the tower. This system 14 may be installed and is operable while the transmission lines 4 are under power.

Figure 5:
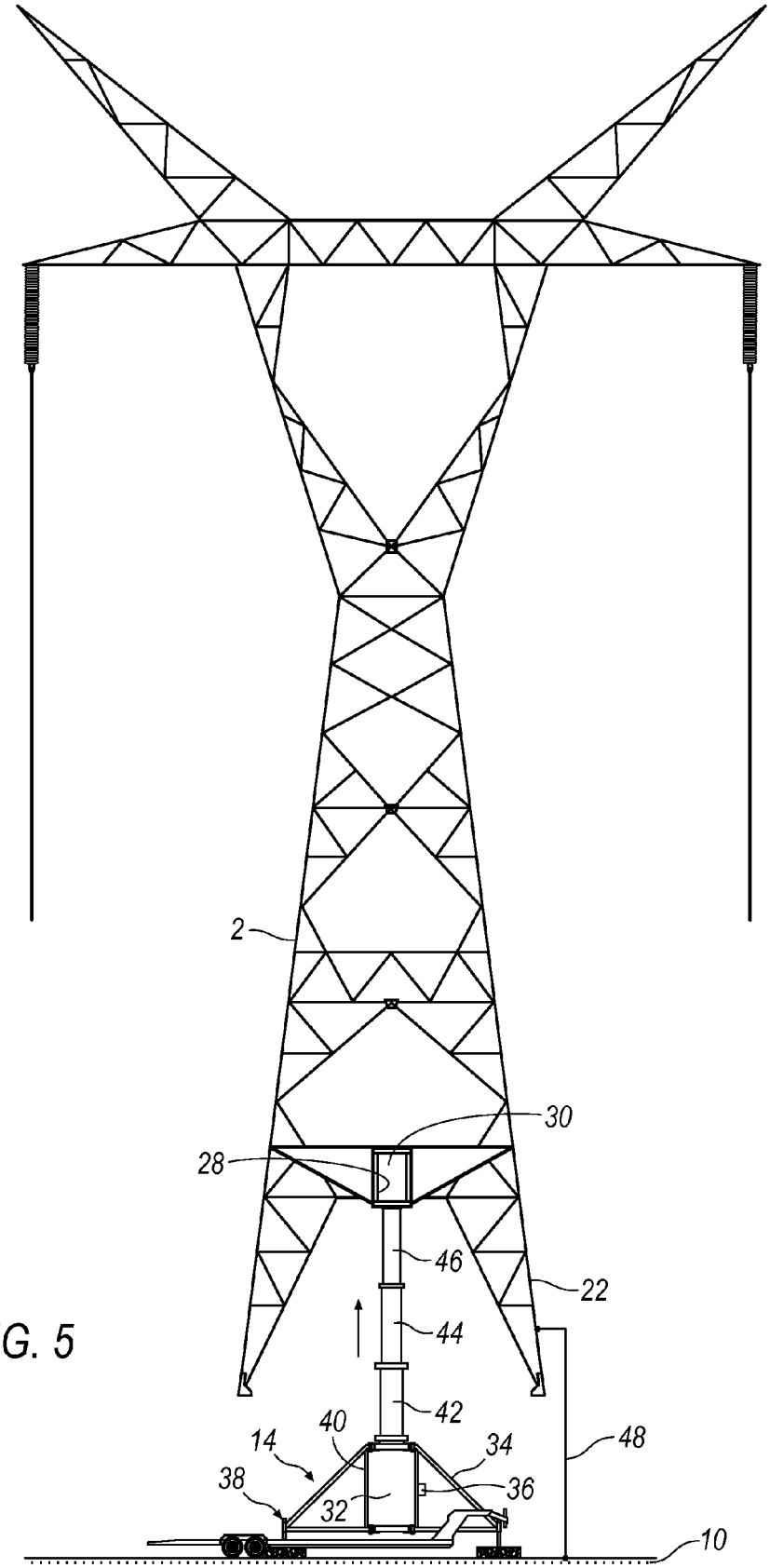
FIG. 5 illustrates a lifting stand system having lifted the transmission tower to its new position.

FIG. 5 illustrates jack 32 in an engaged upper position. An electrical ground 48 is shown extended, which results due to its flexibility in design. It will be appreciated that other electrical grounding systems can be employed. It will be important that they allow for the tower 2 to be lifted off of the earth, while remaining live with current flowing through at a desired voltage, the transmission lines 4, all the while protecting a worker from being injured.

Figure 6A:
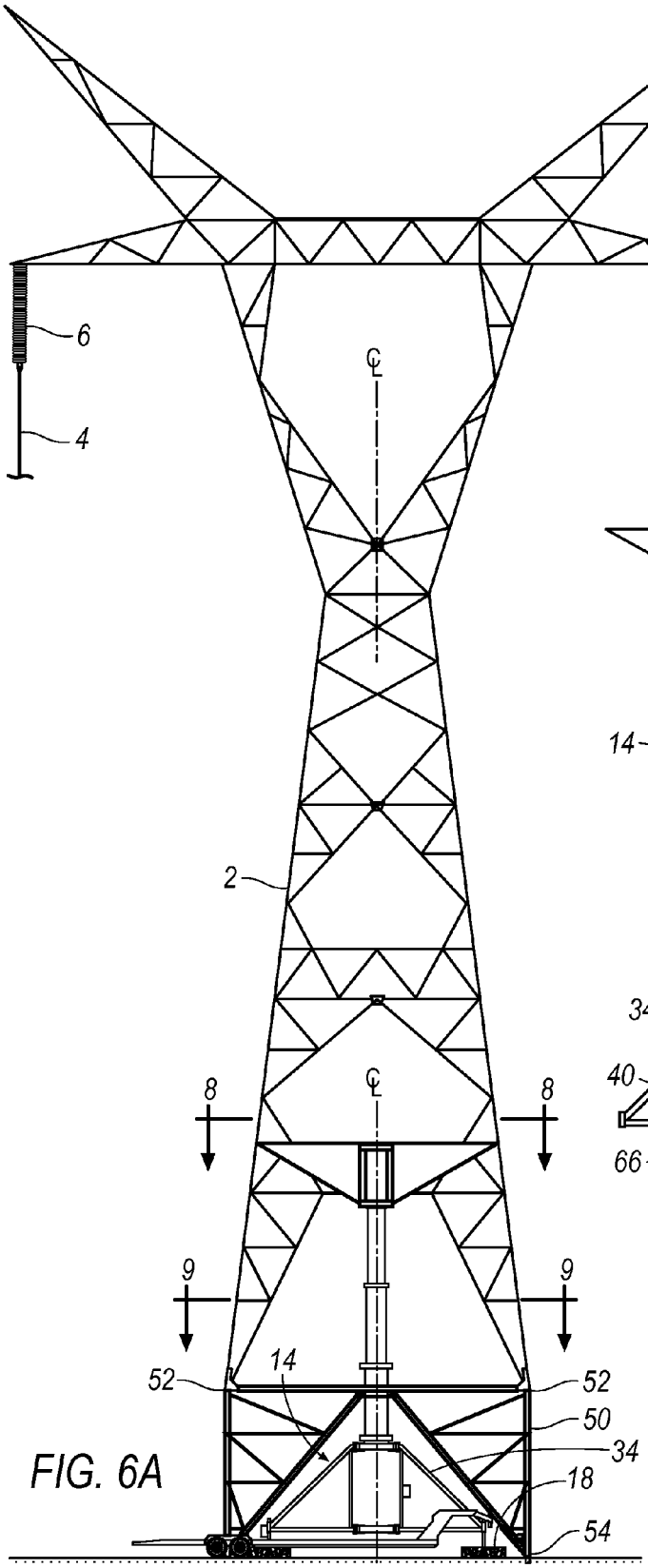
FIG. 6A illustrates a transmission tower having its new vertical extension section installed.

FIG. 6A illustrates the tower 2 after having been lifted up to its elevated position. Once the tower 2 has been moved to this position, it is now ready to have a vertical extension section 50 installed in the space that has been created by the lifting of the tower. The vertical extension section 50 is bolted at its corners 52 to the tower 2 by using conventional fastening mechanisms and methods. The base 54 of the vertical extension section 50 sets in the same position that the tower 2 had set prior to undertaking this maintenance process. Thus, the section 50 is re-anchored to the prior mounts that were used originally to anchor the tower 2. During the period when the tower 2 is in the elevated position as shown in FIG. 6A, it will be important to maintain the tower lifting stand system 14 in a stable position. The transmission lines 4 are kept intact with the tower insulators 6 during this maintenance process so as to keep the tower active and under power during this maintenance process. Thus, it is important that the present method of maintaining the tower 2 not interrupt the usage of the tower during this maintenance process. This is in part accomplished by the outriggers 34 being maintained on a solid foundation such as the pads 18. It will be appreciated that the outriggers 34 could be anchored to the ground directly so as to provide enhanced stabilization of the tower lifting stand system 14.

Figure 6B:
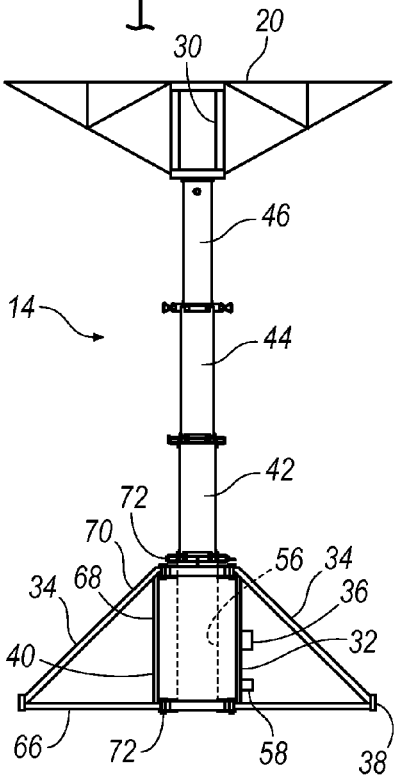
FIG. 6B illustrates the FIG. 6A lifting stand system in its extended position, but with the tower removed for clarity purposes.

FIG. 6B illustrates the tower lifting stand system 14 in an extended position, as shown in FIG. 6A. The hydraulic jack 32 is shown with a pair of outriggers 34 on opposite sides of its body or housing 40. For simplicity purposes, only two outriggers 34 are shown in this illustration. It will be appreciated that multiple outriggers 34 can be placed around the perimeter of the housing 40 as is desired for a particular application of this system. The hydraulic jack 32 is shown with its telescoping sections 42, 44 and 46 fully extended. The telescoping sections are operable to be recessed within a cavity 56 of the hydraulic jack 32 when the system is not being used. The sections will be stored in this position during a transport mode between job sites.

The head stand 20 is shown with the upper part of telescoping section 46 locked into place by the head stand locking mechanism 30. The locking mechanism 30 can be accomplished by hydraulic actuating members either mounted relative to the telescoping section 46, or relative to the head stand 20. The head stand locking mechanism 30 can be activated by a remote device 58 which allows an operator to stand on the ground and to accomplish the connection of the head stand 20 relative to the hydraulic jack 32. It will be appreciated that other mechanisms could be employed so as to securely fasten the head stand 20 to the hydraulic jack 32.

Figure 7:
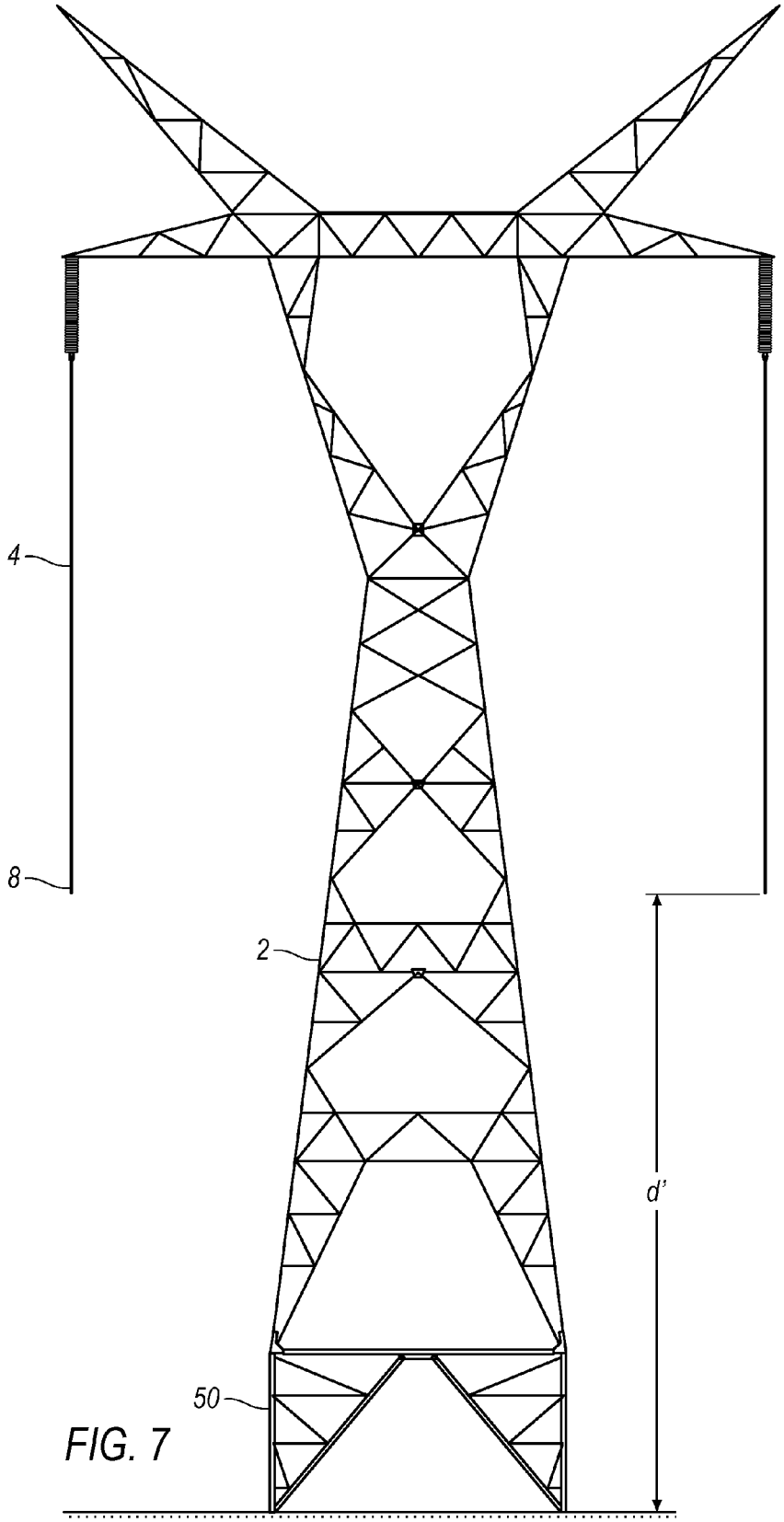
FIG. 7 illustrates the lifting stand system having been removed from the transmission tower.

FIG. 7 illustrates a tower 2 that has been raised and the vertical extension section 50 having been properly installed. The tower 2 now has been lifted to a new height of a distance of d'. By lifting the tower to a new distance of d', the transmission lines 4 have now been raised so that their lowermost point 8 is further off of the ground, thus reducing the potential for contact with the transmission line.

Figure 8:
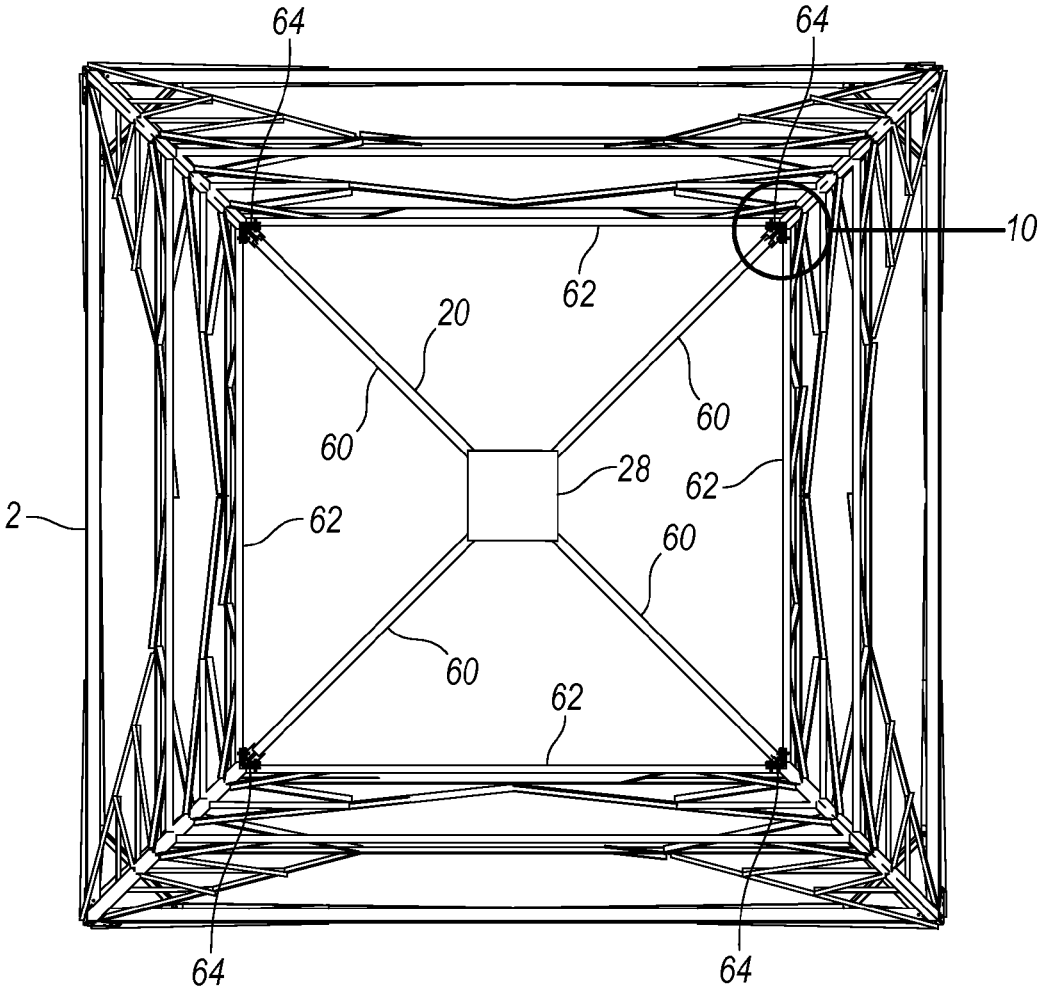
FIG. 8 illustrates a view taken from the perspective of arrow 8-8 of FIG. 6A, showing the stand head connected to the transmission tower.

FIG. 8 illustrates a top view taken from a perspective of line 8-8 of FIG. 6A. The various sections of the tower 2 are shown along with the structure of the head stand 20 secured into position at four locations. The head stand 20 has a plurality of cross members 60 and outer members 62 that collectively are secured together to create a rigid structure. At the center of that rigid structure is the receiver 28 that is operable to receive an end of the telescoping section 46. Each corner of the head stand 20 is secured to a section 64 of the tower 2.

Figure 9:
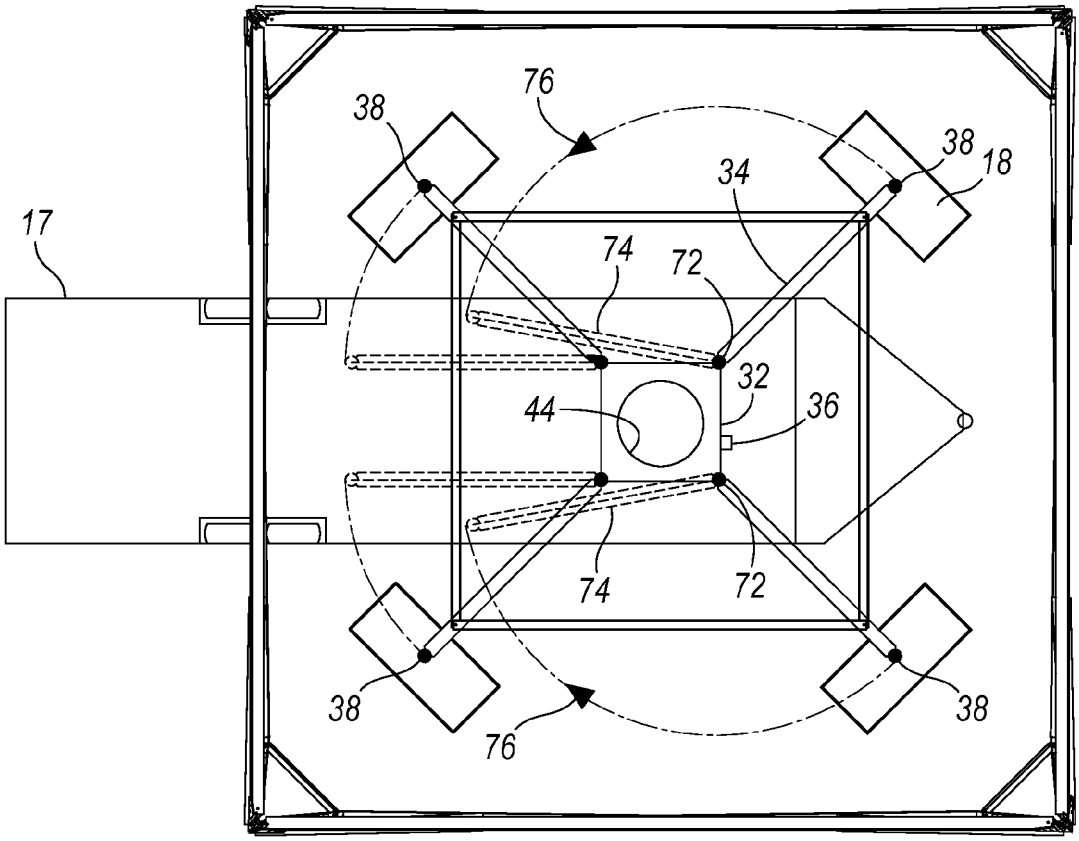
FIG. 9 illustrates a view taken from the perspective of arrow 9-9 of FIG. 6A, showing the positioning of the outrigger assemblies locked in the operational mode.

FIG. 9 illustrates a top view taken from the perspective of line 9-9 of FIG. 6A, showing the hydraulic jack 32 and its four outriggers 34 rotated into an operational position. The trailer 17 is shown located in position relative to the jack 32. With reference to both FIGS. 6B and 9, the outriggers 34 each include a generally triangle shaped structure having a base 66, a vertical member 68 and an angled section 70. A pivot member 72 is located at the top and bottom of the outrigger 34. The pivot member 72 provides a pivot mechanism for securing the outrigger assemblies 34 to the body 40 of the hydraulic jack 32. It will be appreciated that the outriggers 34 may be selectively disconnected from the hydraulic jack.

The outer end of each outrigger assembly 34 includes a leveling system 38 for leveling the tower lifting stand system 14 relative to the earth. The leveling indicator 36 tells the operator when the leveling system 38 is properly in place. It is important that the centerline of the hydraulic jack 32 be in alignment with the centerline of the tower 2, which is also in alignment with the head stand 20. The leveling system 38 helps accomplish this task. For example, FIG. 6A illustrates the centerlines of the jack 32 and the tower 2 in alignment. This provides for proper vertical positioning of the tower 2 during the maintenance process.

With continued reference to FIG. 9, the outrigger assemblies 34 are shown in their deployed position being mounted on top of pads 18. It will be appreciated that the outriggers may be advanced to a stowed position 74 (shown in phantom) which can be accomplished by rotating the outrigger assembly 34 in the direction of the arrow 76.

Figure 10:
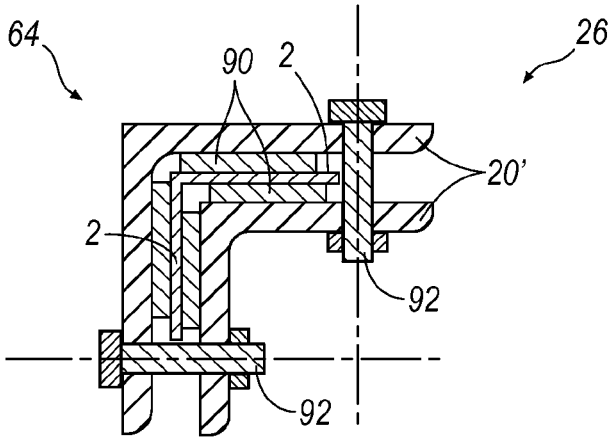
FIG. 10 illustrates an enlarged cross-sectional view taken from circle 10 of FIG. 8, showing a tower head clamping system.

FIG. 10 illustrates a cross-sectional view 64 taken from the circle 10 shown in FIG. 8. This section 64 illustrates a reusable tower clamping mechanism 26, which serves a purpose of affixing the tower head stand 20 to the existing tower structure 2. The clamping mechanism 26 includes a pair of spacers 90 that juxtapose the frame of the tower 2. Adjacent to the spacers are stand head members 20' which form a part of the stand head 20. Fasteners 92 are used to clamp the structures together in an easy fashion. The clamping mechanism is located at each corner where the stand head 20 and tower 2 meet.

Figure 11A:
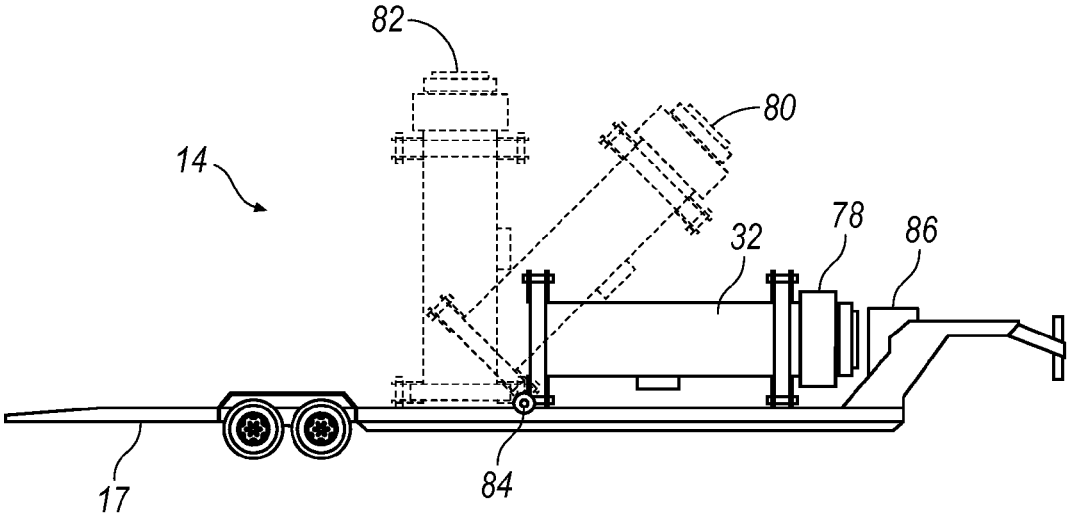
FIG. 11A illustrates a hydraulic lifting system that can be articulated from a transport position to an operational position.
Figure 11B:
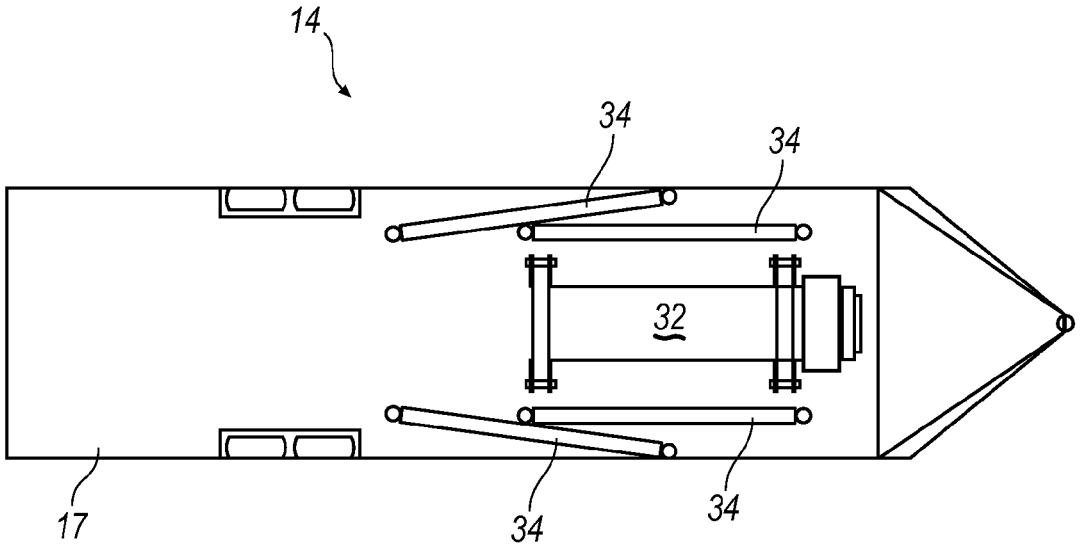
FIG. 11B illustrates a top view of the FIG. 11A system.

FIGS. 11A and 11B illustrate an alternative arrangement of the FIG. 2 tower lifting stand system 14. In this arrangement, the hydraulic jack 32 can be transported on the trailer in a lowered or horizontal position 78. Once at the jobsite, an operator can advance the hydraulic jack from its lowered position to a middle position 80 and then to its locked upright position 82. This raising feature can be accomplished manually or with the aid of an actuator. A pivot mechanism 84 allows the jack 32 to rotate about an axis of the pivot mechanism 84. It will be appreciated that once the jack 32 has been advance to the locked upright position 82, the system 14 can then be deployed for lifting a tower 2. It will further be appreciated that the aforementioned outrigger assemblies 34 could be utilized with this illustrative example, which are shown in FIG. 11B in the transport position.

Figure 12A:
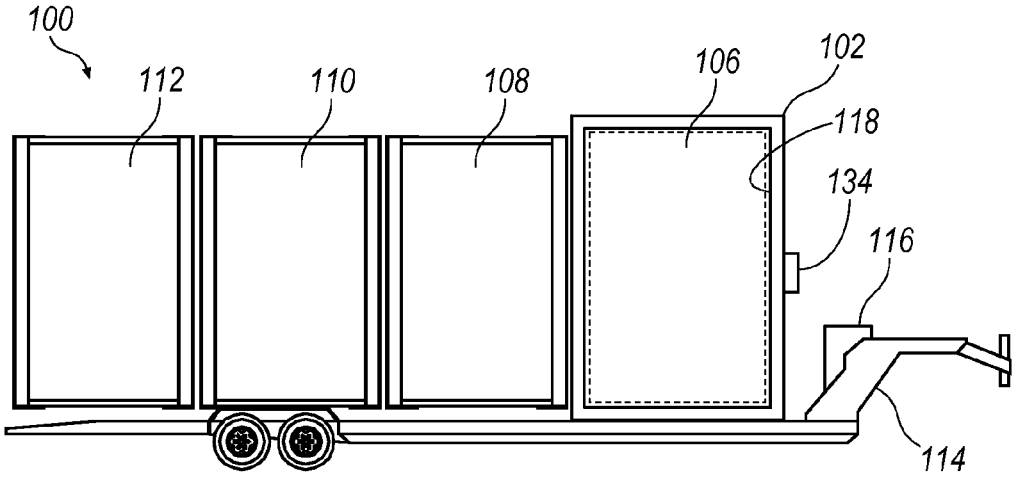
FIG. 12A illustrates a side view of an alternative lifting stand system.

With reference to FIG. 12A, an alternative tower lifting stand system 100 is illustrated which includes a mechanical lift 102, outrigger assemblies 104, ladder sections 106, 108, 110 and 112, and a trailer 114. The trailer 114 is operable to be connected to a vehicle 16 so that the system 100 can be transported easily from job site to job site. Further, the trailer 114 must be sufficiently rugged so as to allow it to be maneuvered across rugged terrain conditions. It should be possible to connect the trailer 114 to an all-terrain vehicle when it is desired to use the system 100 in more difficult environmental situations.

The mechanical lift 102 can be the type used by operators when building large cranes that are used during high-rise building projects. The mechanical lift 102 can be powered by a power unit 116 which could impart power to a lift system 118. The lift system 118 is operable to receive a plurality of ladder sections 106, 108, 110 and 112 which in turn can be lifted one by one in a vertical manner in order to create a raised vertical section for imparting motion to an underside of the tower 2. In the present exemplary approach, it is contemplated that four ladder sections, 106, 108, 110 and 112, could be connected in tandem through mechanical fastening methods which are well known. An example of four ladder sections being connected can be seen in FIG. 19. It will be appreciated that other types of mechanical lifts or lifting mechanisms 102 are contemplated to be used with the present method of lifting a tower or structure. Any such lifting mechanism must provide controllable axial movement and be operable to lift significant loads.

Figure 12B:
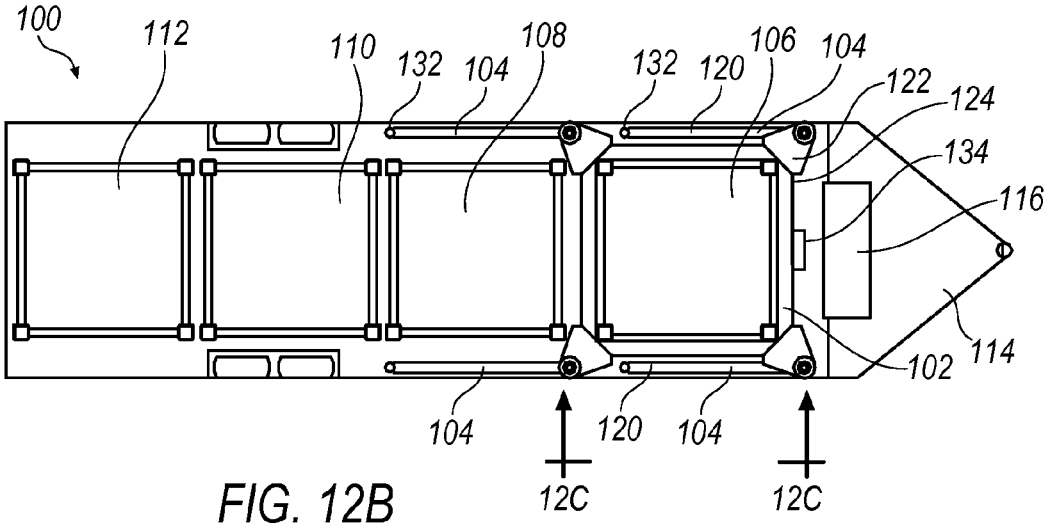
FIG. 12B illustrates a top view of the FIG. 12A alternative system.

The tower lifting stand system 100 also includes a plurality of outrigger assemblies 104, each of which can be connected to a corner of the mechanical lift 102. As shown in FIG. 12B, the outrigger assemblies 104 are shown in a stowed position relative to the trailer 114, during the transport mode. Each outrigger assembly 104 includes an outrigger arm 120 and a pivot locking mechanism 122. Each pivot locking mechanism 122 is connected to a housing 124 of the mechanical lift 102 at both the upper and lower portions of the mechanical lift 102. Each pivot locking mechanism 122 further includes a pivot feature having a vertical axis for providing pivotal rotation of each outrigger arm assembly 120 relative to the housing 124.

The outrigger arm assembly 120 includes a vertical member 126, a base member 128 and an angled member 130. A leveling mechanism 132 is located at a lower end of the outrigger assembly 104. The pivot locking mechanism 122 further includes a mechanical lock for securing its outrigger arm 120 into a predetermined locked position during the operational mode. The pivot locking mechanism 122 also has a stowed lock position for maintaining the outrigger arms 120 in a stowed position while being transported upon trailer 114. With continued reference to FIG. 12B, the outrigger assemblies 104 are shown in their stowed position but they are operable to be advanced to a deployed position so that the lifting stand system 100 can be used at the job site. Thus, the pivot locking mechanism 122 operates to secure the outrigger arm 120 into its desired position based upon current usage demands.

A level sensor 134 is in communication with the housing 124 of the mechanical lift 102. The level sensor 134 provides the operator visual feedback as to the level status of the mechanical lift 102. The leveling mechanism 132 that is connected to the outrigger assembly 104 is capable of imparting motion to the lifting stand system 100 so as to aid in making it level relative to the earth. Thus, the level sensor 134 and the leveling mechanism 132 aid the operator in assuring and reaching a level state for the lifting stand systems 14 and 100.

Figure 12C:
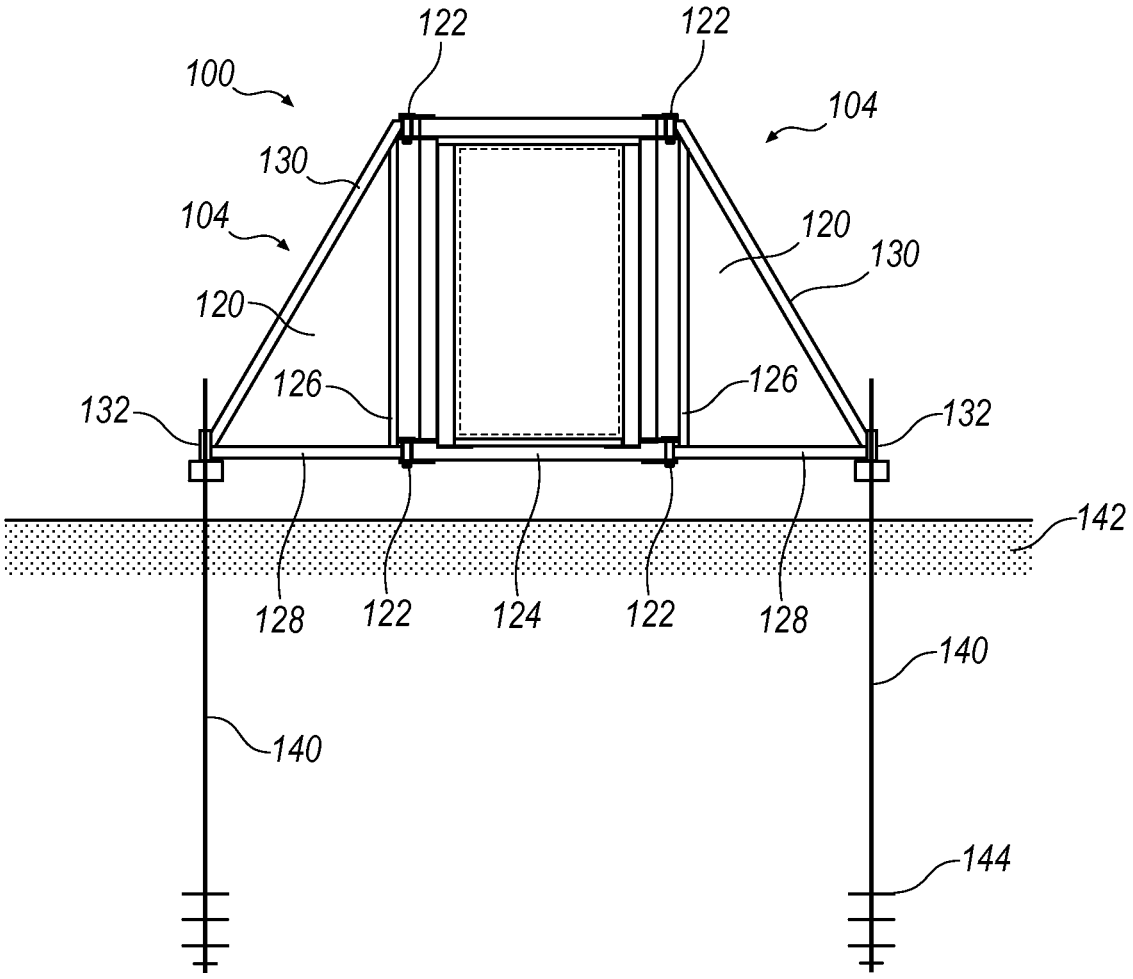
FIG. 12C illustrates the FIG. 12A alternative lifting system with two of its outriggers shown extended and secured to the ground.

FIG. 12C illustrates a side elevational view of an alternative example of the lifting stand system 100 being anchored to the ground. In this example, the lifting stand system 100 does not utilize pads or crane mats upon which the stand system 100 rests. Instead, pylons 140 are anchored to the ground 142 by using augers 144, or the like. It will be appreciated that pylons 140 could anchor each outrigger arm 120.

Figure 12D:
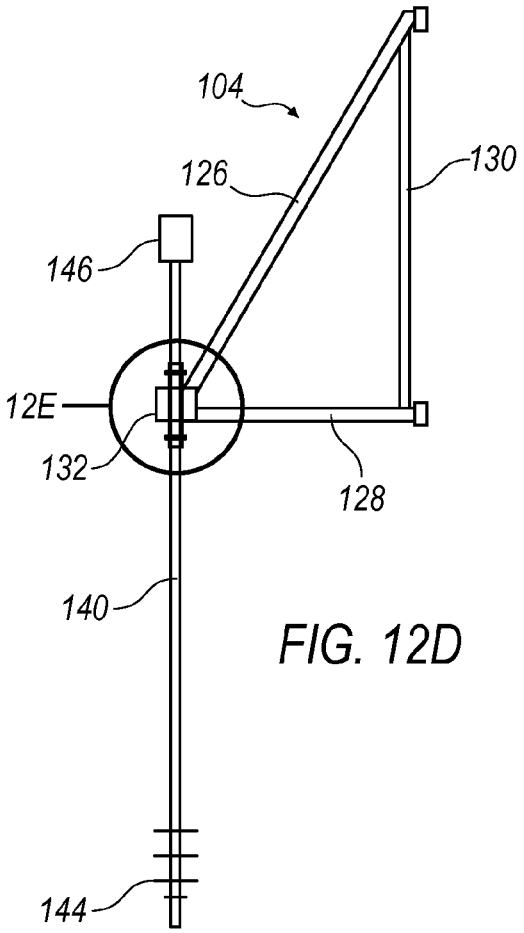
FIG. 12D illustrates an anchor driving mechanism that is used with the outrigger of the FIG. 12A lifting stand system.
Figure 12E:
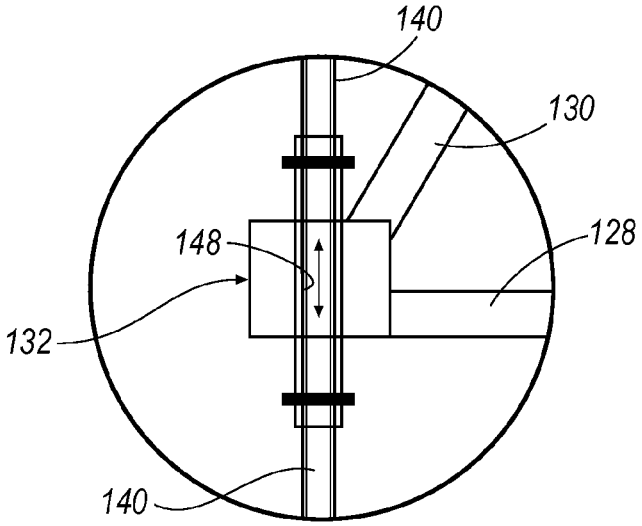
FIG. 12E illustrates an enlarged view of circle 12E of FIG. 12D, showing a hydraulic leveling assembly used in connection with a lifting stand system.

FIGS. 12D and 12E illustrate a schematic view of one of the outrigger assemblies 104 that are shown in the FIG. 12C embodiment. The pylon 140 is shown extending through the leveling mechanism 132. A powered driver 146 can be powered for imparting rotational movement to the pylon 140. A screw system 148 can be part of the leveling mechanism 132. Thus, when driver 146 is activated, it causes the pylon 140 to rotate down into the earth so as to provide a strong anchoring feature for the lifting stand system 100. Once the pylon 140 is positioned, the leveling mechanism 132 can be activated, either hydraulically, pneumatically, electrically, or by some other means, thus allowing the outrigger assemblies 104 to move relative to the pylon 140 to a desired level position.

Figure 13:
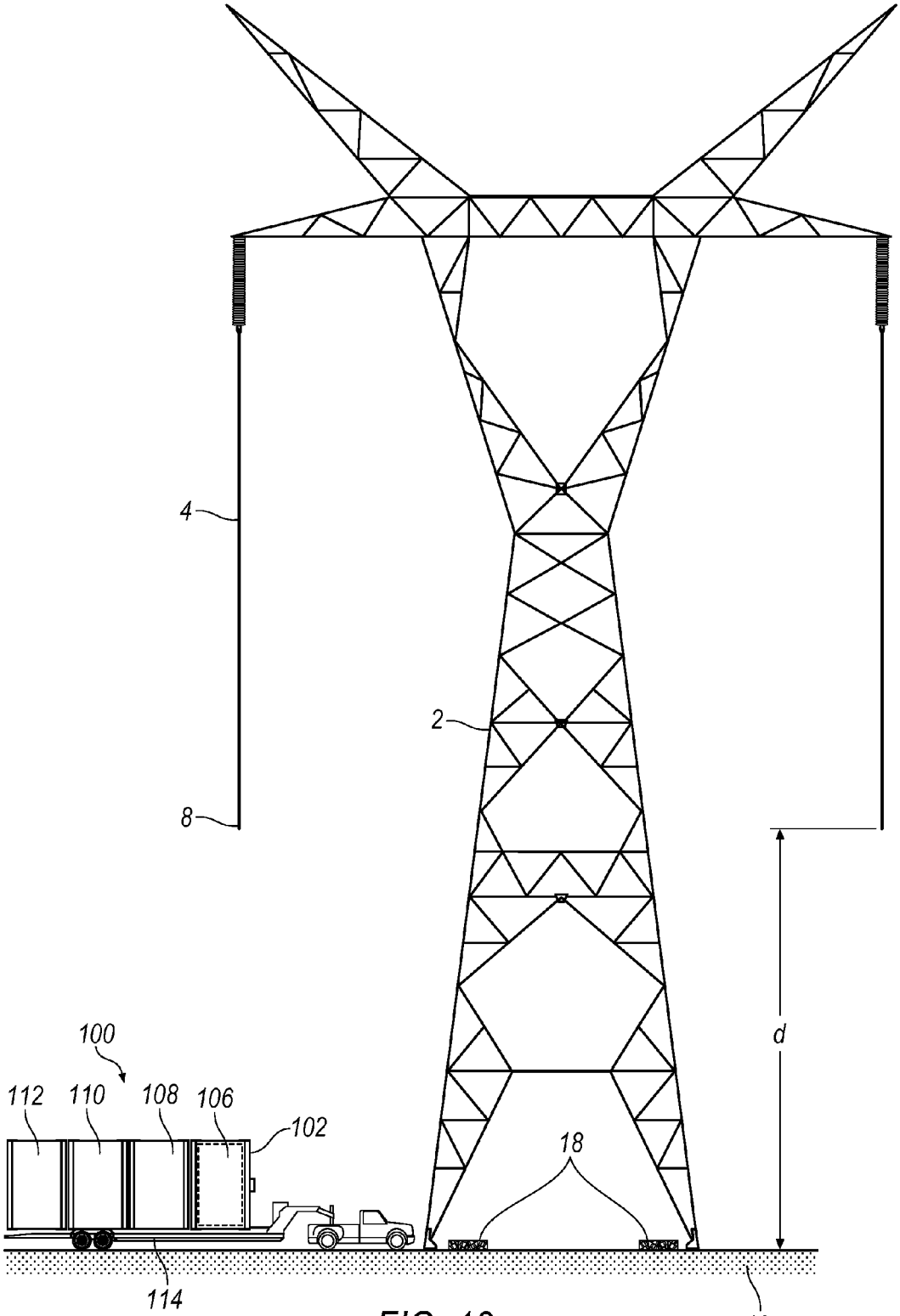
FIG. 13 illustrates an alternative tower lifting stand system at the job site.

FIG. 13 illustrates an alternative tower lifting stand system 100 being positioned at a work site. A tower 2 is shown having transmission lines 4 that sag to a lowermost point 8. The sagging transmission lines 4 are located a distance d off of the ground 10, which under these circumstances, should be improved. The trailer 17 is shown loaded with the lift 102 and the four ladder sections 106, 108, 110 and 112.

Figure 14:
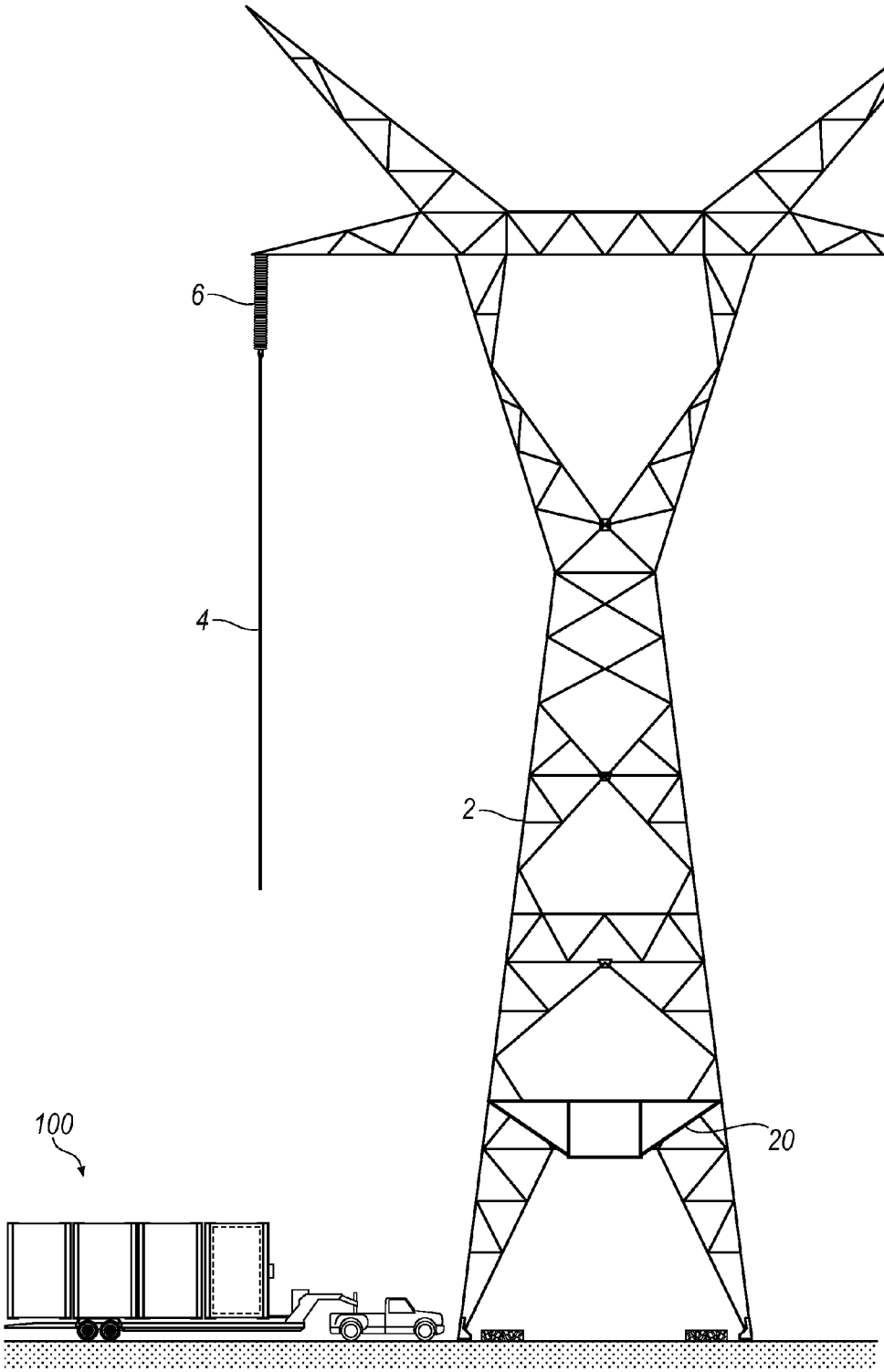
FIG. 14 illustrates a stand head secured to the transmission tower.

FIG. 14 illustrates the next step where a stand head 20 is secured in position relative to the tower 2. The stand 20 is connected to the tower 2 utilizing the same system and mechanism as discussed above and as shown in FIG. 10. The stand head 20 is reusable and is made of structural steel.

Figure 15:
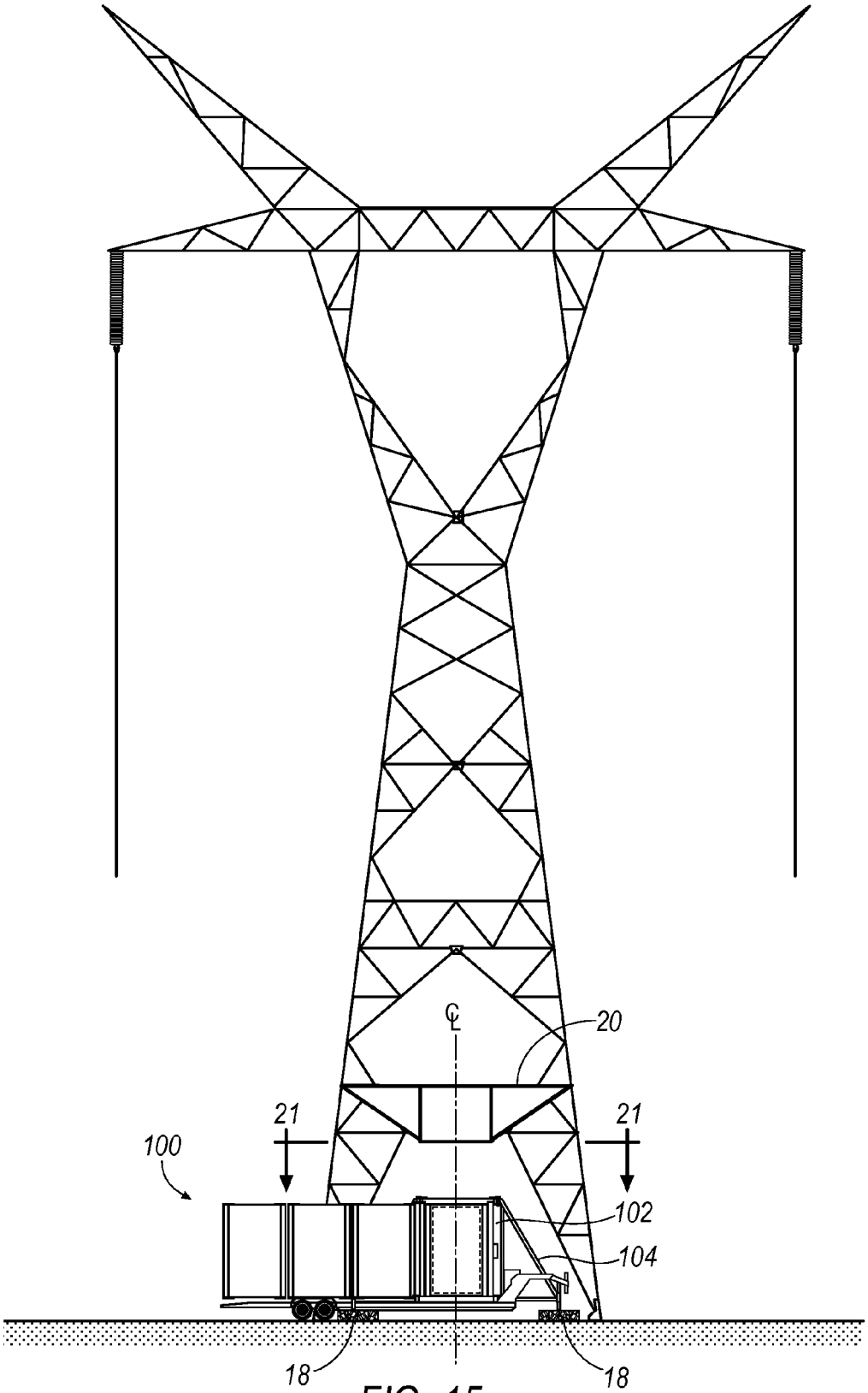
FIG. 15 illustrates the lifting stand system shown in place underneath the transmission tower.

FIG. 15 illustrates the step of a the tower lifting stand system 100 being advanced to a position where the centerline of the mechanical lift 102 is aligned with the centerline of the head stand 20. Each outrigger assemblies 104 have been fully deployed and they rest upon pad 18. Only two outriggers 104 are shown in this Figure for simplicity purposes, however, it will be appreciated that all of the outrigger assemblies 104 should be deployed and resting on their respective pads at this step. Once the outrigger assemblies 104 have been fully deployed, the lift 102 is completely off of the trailer 17.

Figure 16:
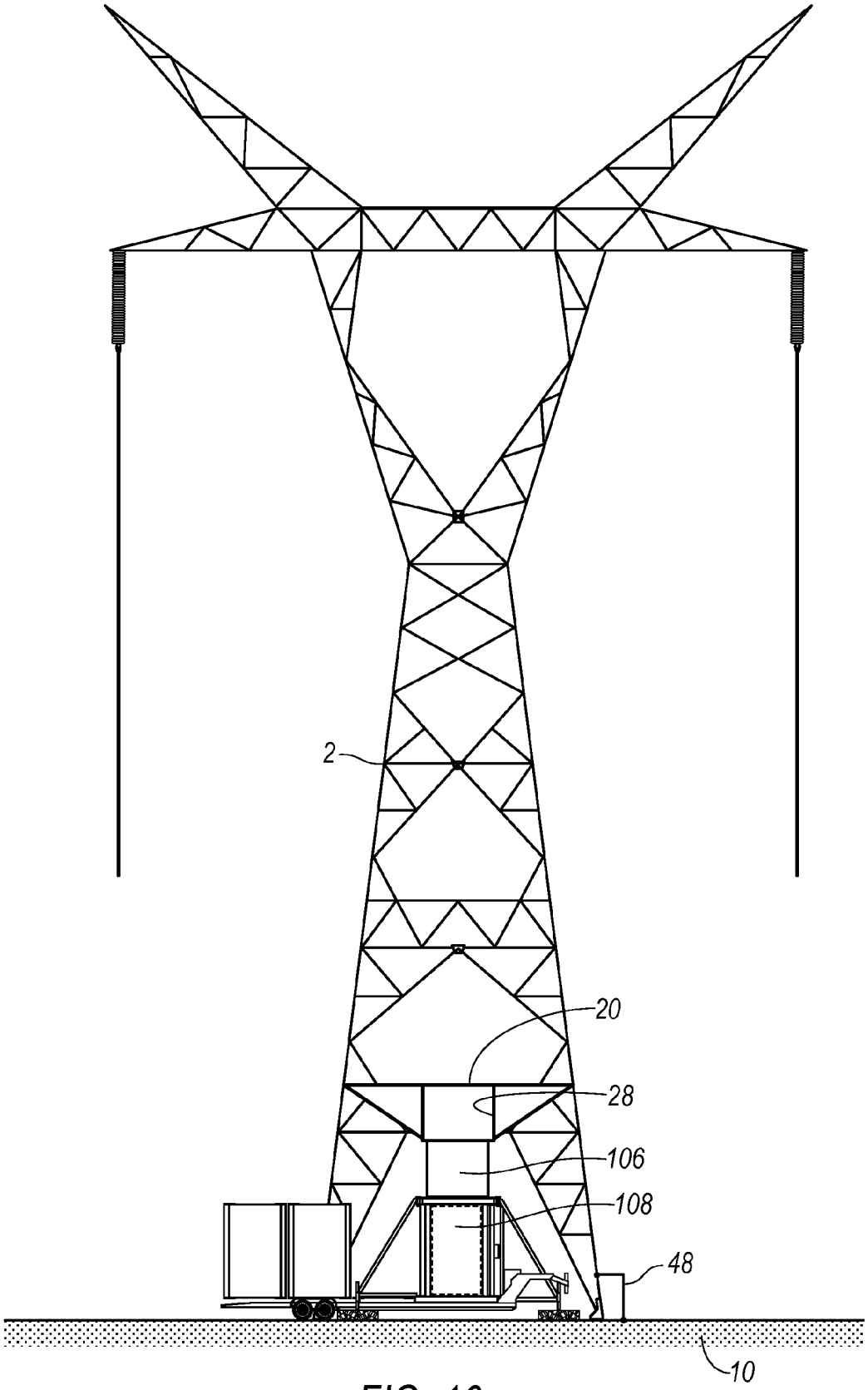
FIG. 16 illustrates the lifting stand system having two modular sections loaded into the mechanical lift.

FIG. 16 illustrates the step of a ladder section 108 now being inserted into the mechanical lift 102. At this point, the ladder section 106 has now been advanced upwardly into the receiver 28 of the head stand 20. At this step the tower 2 is still resting firmly on the ground 10.

Figure 17:
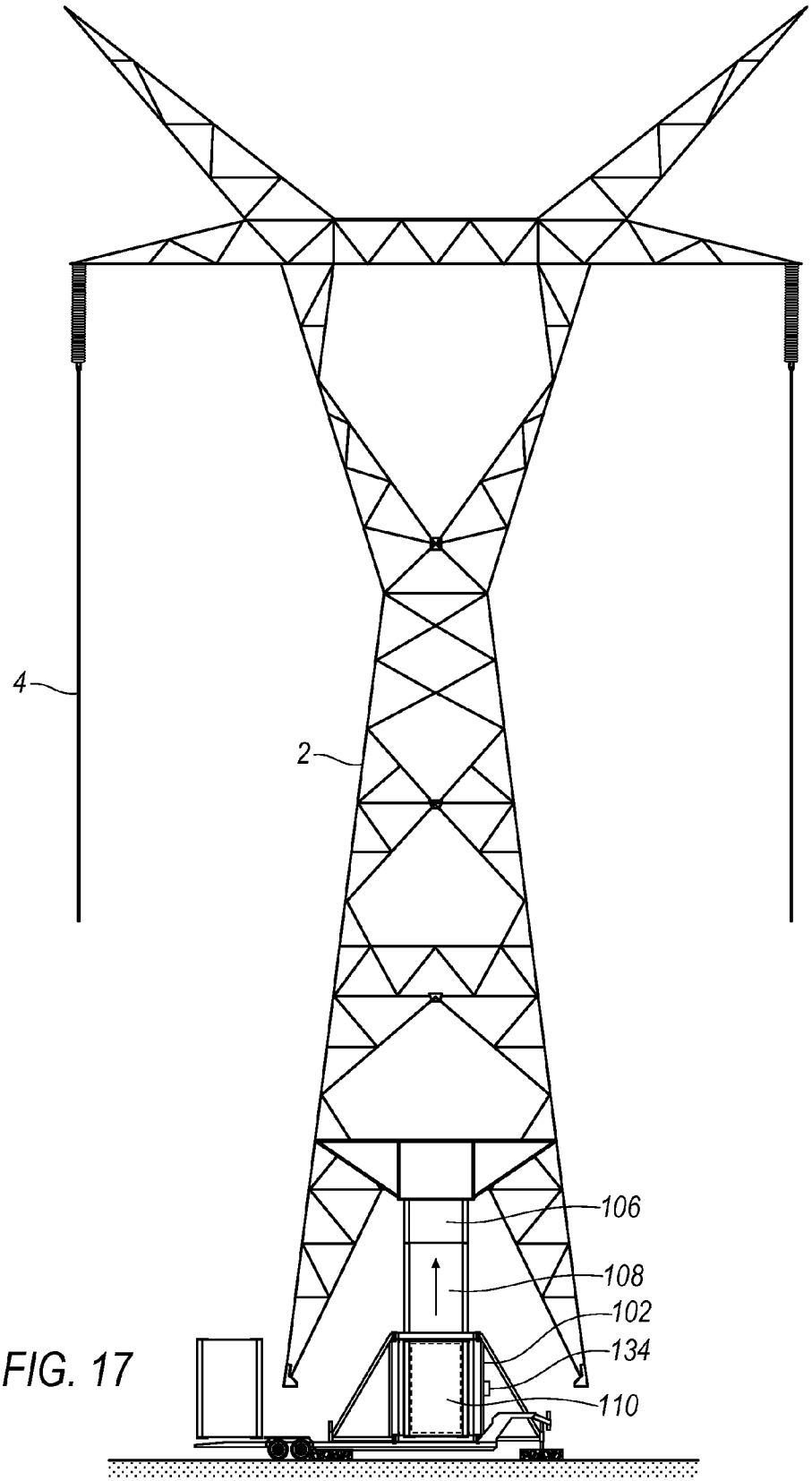
FIG. 17 illustrates the lifting stand system having three modular sections installed, thus causing the transmission tower to be lifted off of the ground.

FIG. 17 illustrates the step of the ladder section 110 being advanced to the mechanical lift 102. At this step the mechanical lift 102 has caused the tower 2 to now clear the ground resulting in the tower 2 and wires 4 being lifted. The leveling sensor 134 can now be inspected so as to make certain the tower 2 is in proper vertical orientation. If it is not level, the leveling mechanism 132 can be activated in order to reorient and level the lifting stand system 100. At this time, over 45,000 pounds of pressure are being exerted downwardly on the lifting stand system 100 as a direct result of the weight of the tower 2 and the power lines 4 exerting their downward forces. Thus, both the system 14 and 100 must be sufficiently rugged to withstand these compression forces.

Figure 18:
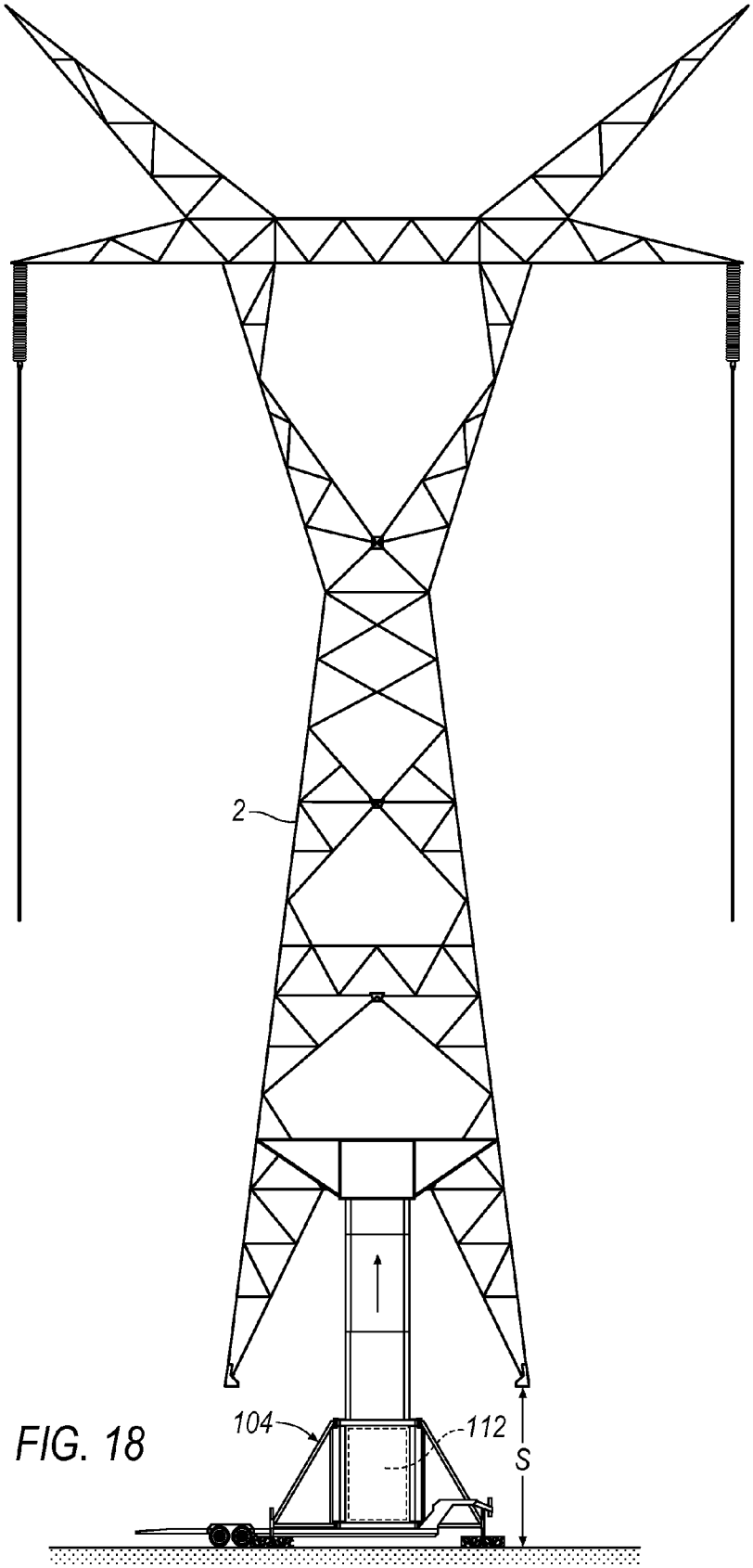
FIG. 18 illustrates the transmission tower fully lifted by the lifting stand system.

FIG. 18 illustrates the step of the tower 2 being lifted up off the ground a predetermined distance. At this step, the ladder section 112 has been installed in the mechanical lift 104 thus providing the added vertical lift that is desired for this maintenance project. At this time, a space s is now provided under the tower 2 which provides sufficient vertical height to satisfy the maintenance requirements for this project. The lifting stand system 100 has now reached its desired vertical maximum position and it is now locked into position so that maintenance can proceed on the tower 2.

Figure 19:
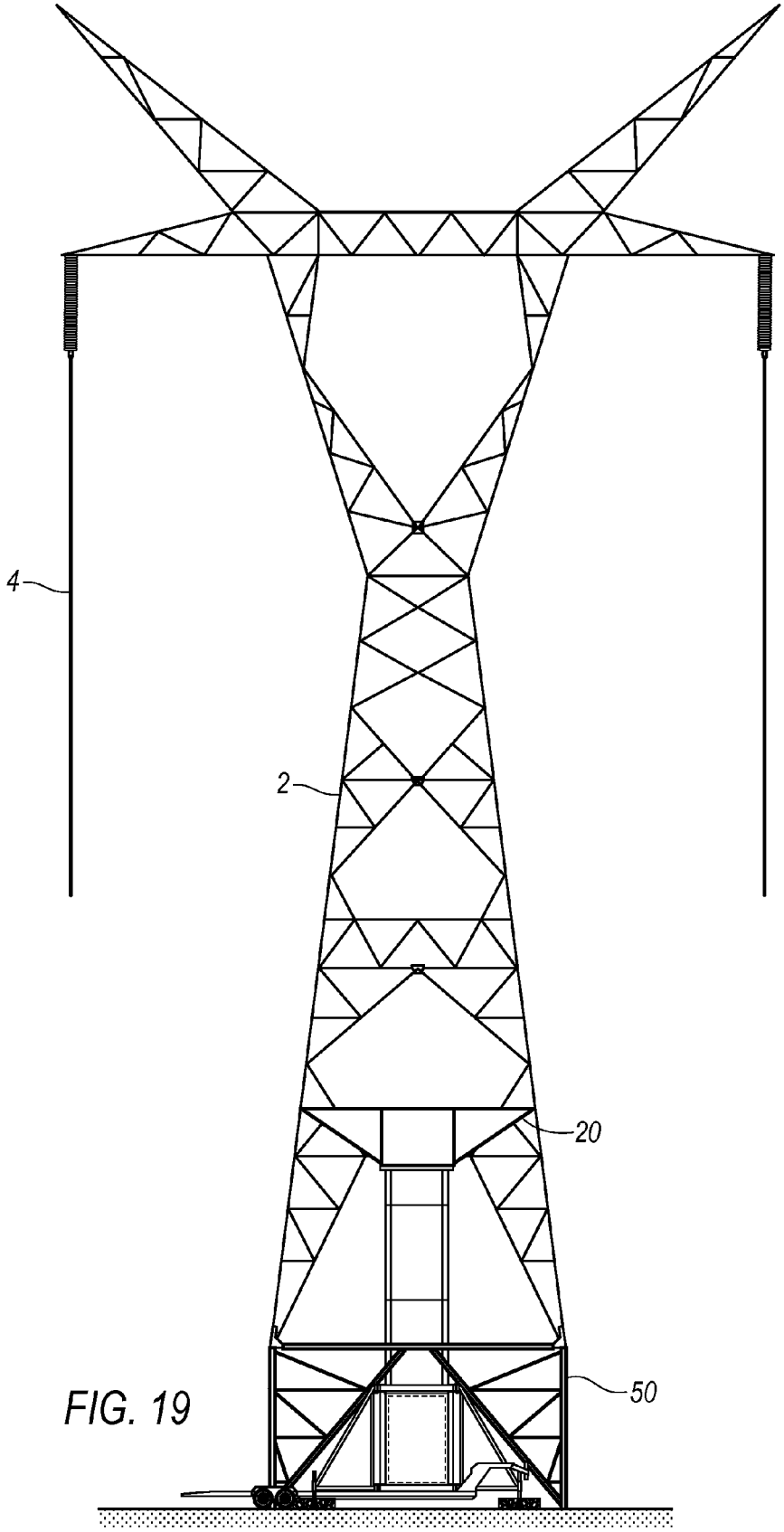
FIG. 19 illustrates the transmission tower with the vertical extension section installed.

FIG. 19 illustrates the step of a vertical extension section 50 being constructed around the lower portion of the tower 2. The lifting stand system 100 is sufficiently streamlined in size and configuration so as to allow operators to easily install the vertical extension section 50 around the lifting stand system 100, while it remains in place. Once the vertical extension section 50 has been fully installed and secured to the tower 2, the lifting stand system 100 can then be removed. This is accomplished by each of the ladder sections 112, 110, 108 and 106 being uninstalled in the reverse manner as discussed above. Once all of the ladder sections have been uninstalled, the tower 2 is then left standing freely on its newly installed vertical extension section 50. At this time, the head stand 20 can now be unsecured from the tower 2.

Figure 20:
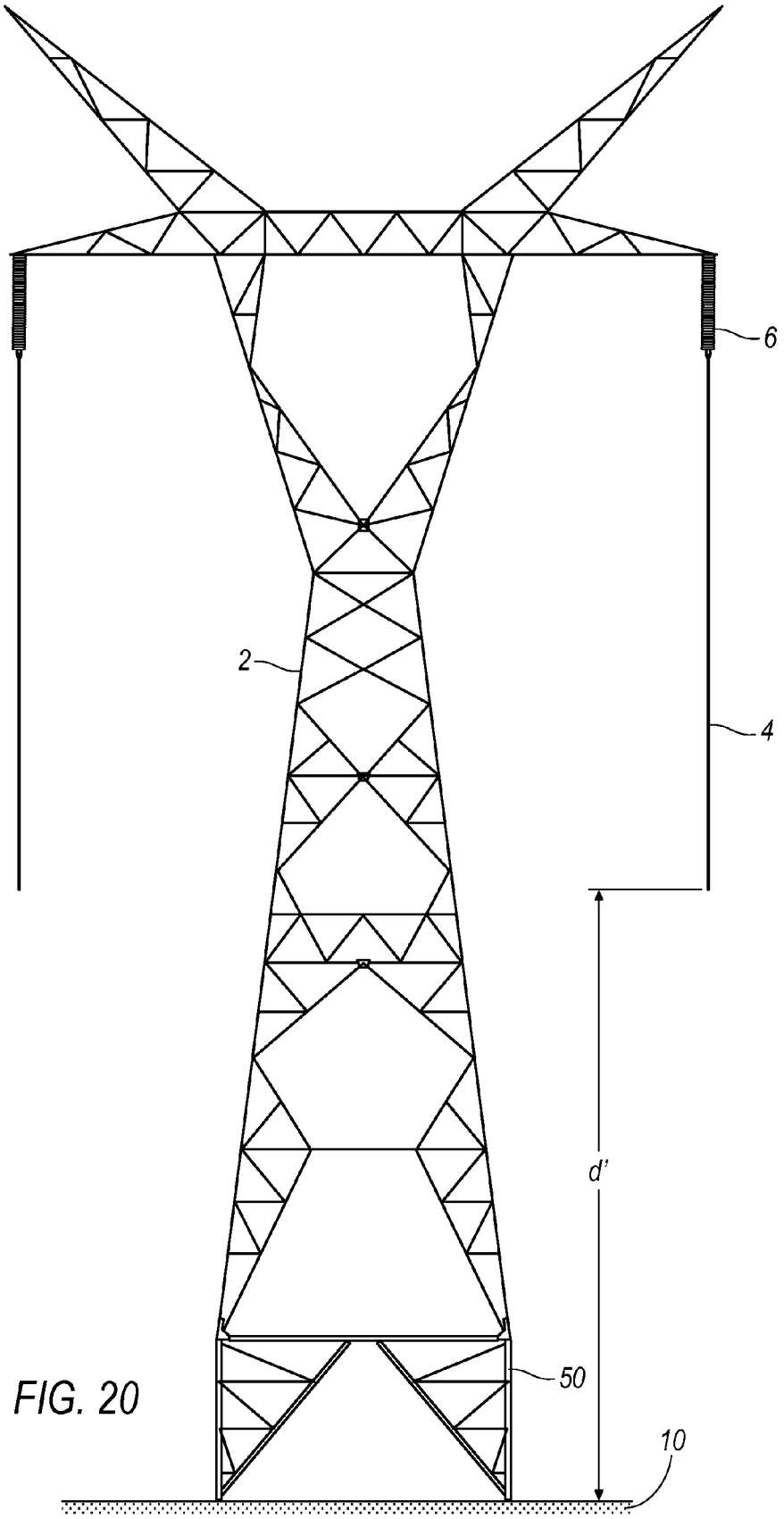
FIG. 20 illustrates the transmission tower after it has been raised and the power lines having been lifted further off of the ground.

FIG. 20 illustrates the FIG. 19 tower 2, but with the novel tower lifting stand system 100 removed. The tower 2 has now been updated such that the distance between the sagging line 4 and the ground 10 has been increased to d'. This enhanced distance d' now provides greater clearance in the space underneath the transmission lines 4.

Figure 21:
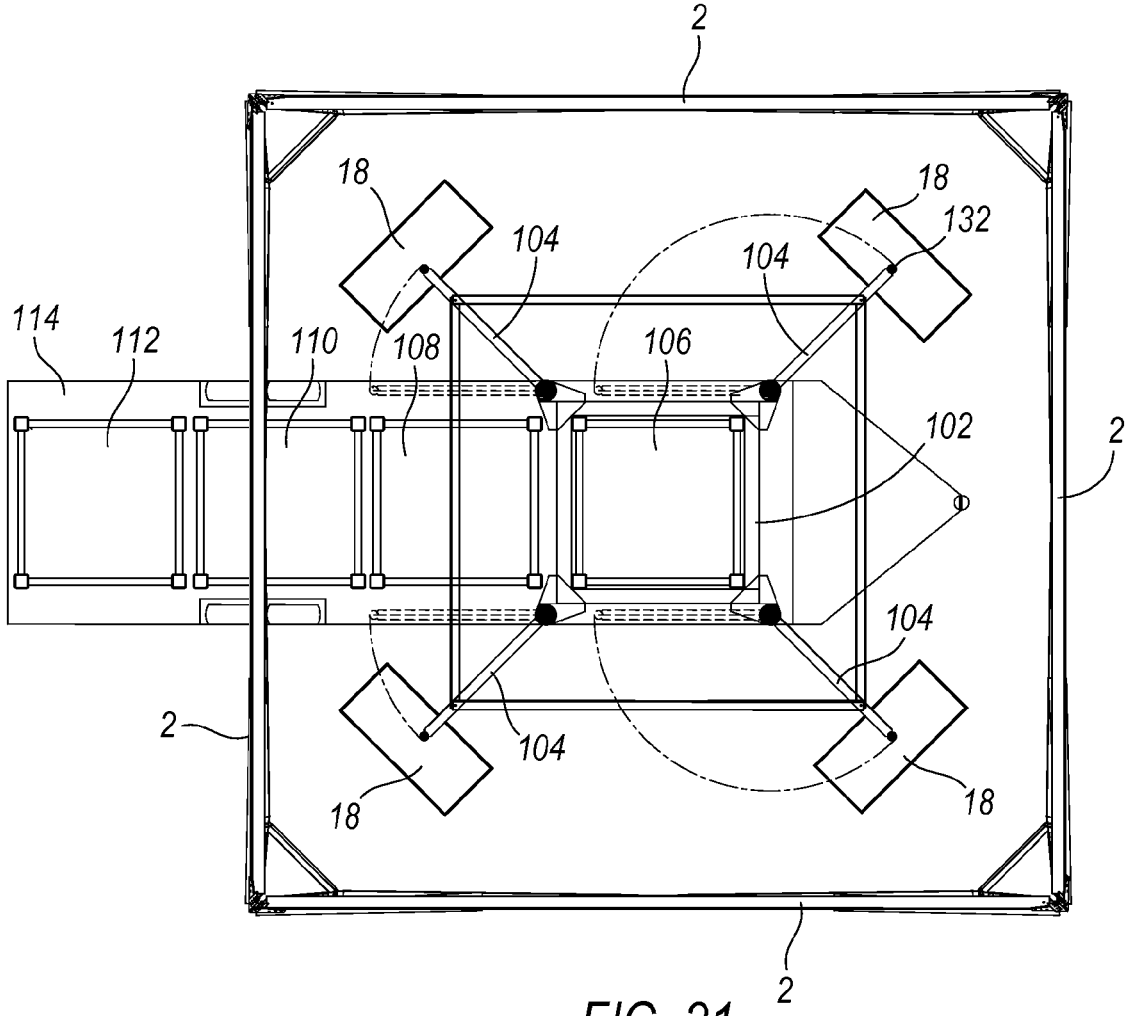
FIG. 21 illustrates a top view taken from line 21-21 of FIG. 15, showing four outrigger assemblies deployed.

FIG. 21 illustrates a top view of the FIG. 15 exemplary system taken from lines 21-21. The outrigger assemblies 104 have each been deployed to their in-use position where the leveling mechanism 132 has been centered relative to pad 18. By providing four outrigger assemblies 104 at distally opposed positions, the mechanical lift 102 can be firmly placed on the ground and leveled with the aid of the unique leveling mechanisms 132. Shown in phantom are the outrigger assemblies 104 when they are placed in their stowed position relative to the trailer 114.

Utilizing the tower lifting stand system 14 will now be presented. It will be appreciated that operation of the system 100 will be similar in methodology. A vehicle 16 pulls the tower lifting stand system 14 to a job site and locates it approximate to a tower 2. A head stand 20 is then secured to the tower 2 by conventional fastening means. Crane mats or pads 18 can be installed at appropriate positions so as to provide proper foundation for the hydraulic jack 32 to sit upon. The hydraulic jack 32 can now be energized by a hydraulic power unit 86. The power unit, which can be mounted to the trailer 17, can be a motor with an associated hydraulic pump. As the hydraulic jack 32 is energized, telescoping portions 42, 44 and 46 are in turn energized and advanced to their predetermined maximum vertical positions. As telescoping section 46 engages head stand 20, the locking mechanism 30 locks into place, thus firmly securing the head stand 20 relative to the hydraulic jack 32. Once the locking mechanism 30 has been locked into place, the operator can view a visual indicator on the remote device 58 so as to provide a visual indication that the locking mechanism 30 indeed has been locked. A visual indicator on the remote device 58 could be provided in the form of a green light thus signaling to the operator that all conditions are go.

After the locking mechanism 30 has been confirmed to be in its locking condition, the operator then continues to advance the telescoping sections in an upward direction thus lifting the tower 2 off of the ground. The ground 48 maintains continuity with the tower and the ground 10 so as to assure safety for the operator. Once the hydraulic jack 32 has fully elevated the tower 2 to a desired position, the jack can be locked into place. At this time, the operator can install the vertical extension section 50 in place underneath the tower 2. During this time period the lifting stand system 14 continues to remain level. Once the vertical extension section 50 has been fully installed, the locking mechanism can be released via the remote device 58, thus allowing the operator to lower the telescoping sections back to within the body 40 of the jack 32. Next the leveling system 38 retracts its downwardly extending arms to where the jack then rests on the trailer 17. The outriggers 34 can then be positioned to their stowed or transport position and locked into place for safe traveling. The vehicle 16 can then be hitched to the trailer 17 and the lifting stand system 14 can then be transported to the next job site.

If the telescoping hydraulic jack system 32 of FIG. 11A is deployed, then the operator unlocks the hydraulic jack 32. This then allows the jack 32 to pivot about pivot mechanism 84 and then lowered to its resting position 78.

It will be appreciated that the aforementioned process and devices may be modified to have some steps removed, or may have additional steps added, all of which are deemed to be within the spirit of the present invention. Even though the present invention has been described in detail with reference to specific embodiments, it will be appreciated that various modifications and changes can be made to these embodiments without departing from the scope of the present invention as set forth in the claims. Accordingly, the specification and the drawings are to be regarded as an illustrative thought instead of merely a restrictive thought of the scope of the present invention.

What is claimed as new and desired to be protected by Letters Patent of the United States is:

1. A tower lifting system comprising:
a portable transport device;
a tower head structure configured to be attachable to a tower via a clamp mechanism; and
a lift structure associated with the portable transport device arranged underneath the tower head structure and having a centerline in alignment with a centerline of the tower, the lift structure configured to lift the tower vertically relative to a ground surface, the lift structure including a vertically extendable lift member operable to extend lineally with the centerline of the tower and engage the tower head structure;
wherein the lift member actuates the tower head structure and associated tower vertically lineally with the centerline of the tower relative to the ground surface from a first distance to a second distance greater than the first distance.

2. The tower lifting system as claimed in claim 1, further comprising a leveling device operable to impart motion to the lift structure for leveling the lift structure relative to the ground surface upon which the lift structure traverses.

3. The tower lifting system as claimed in claim 1, further comprising a level indicator configured to indicate alignment of the lift member with respect to the centerline of the tower.

4. The tower lifting system as claimed in claim 1, wherein the lift structure includes an outrigger for stabilizing the lifting system.

5. The tower lifting system as claimed in claim 1, wherein the lift structure includes a hydraulic jack having telescoping sections configured to extend upon application of hydraulic force, the lift member comprising the telescoping sections.

6. The tower lifting system as claimed in claim 1, wherein the lift structure includes a mechanical lift configured to vertically lift a first ladder section relative to the ground surface, maintain the first ladder section in a raised state while a second ladder section interfaces with the first ladder section, and vertically lift the second ladder section, wherein the lift member comprises the first and second ladder sections.

7. The tower lifting system as claimed in claim 1, wherein the tower head structure includes a frame having a plurality of corners and a centrally positioned receiver operable to receive the lift member, wherein each corner of the frame includes a respective clamping mechanism operable to affix the tower head structure to the tower.

8. The tower lifting system as claimed in claim 1 wherein a centerline of the lift member is in alignment with the centerline of the tower, which is in alignment with a centerline of the tower head structure.

9. The tower lifting system as claimed in claim 1, further comprising a locking system operable to connect the lift member to the tower head structure.

10. The tower lifting system as claimed in claim 1, further comprising a power driver for anchoring a pylon into the ground surface for anchoring the lift structure.

11. The tower lifting system as claimed in claim 1, further comprising a vertical extension section disposed between the tower and the ground surface when the lift member actuates the tower head structure and associated tower from the first distance to the second distance.

12. A method of conducting maintenance on a high voltage transmission tower comprising:

placing a lifting mechanism under an electrical tower disposed on a ground surface;

deploying at least one outrigger;

installing a support structure on the tower;

positioning the lifting mechanism beneath the support structure and aligning a centerline of the lifting mechanism with a centerline of the tower;

activating the lifting mechanism to cause a member to vertically extend lineally with the centerline of the tower and receiving the member via the support structure;

continuing to activate the lifting mechanism until the support structure and associated tower have been lifted a predetermined distance vertically above the ground surface;

positioning a vertical extension under the tower and securing the vertical extension to the tower; and retracting the lifting mechanism.

13. The method as claimed in claim 12, further comprising providing a leveling system for leveling the lifting mechanism.

14. The method as claimed in claim 12, further comprising providing a driver for anchoring the lifting mechanism to the ground surface.

15. The method as claimed in claim 12, further comprising providing a trailer for transporting the lifting mechanism to a job site.

16. A tower lifting system comprising:

a portable transport device;

an electrical tower having pre-existing wires such that a distance of the wires from a ground surface are a first dimension, the tower including a head stand with a receiver having an opening oriented toward the ground surface;

a lift associated with the portable transport device disposed under the tower and operable to lift the electrical tower such that the distance of the wires from the ground surface are increased from the first dimension to a second dimension greater than the first dimension; the lift including a lifting stand positioned underneath the receiver and having a centerline in alignment with a centerline of the tower, the lifting stand including a hydraulic jack having an outer body and a plurality of telescoping sections operable to be hydraulically actuated by the hydraulic jack and to exert an upward force; and wherein an uppermost telescoping section of the hydraulic jack is operable to vertically extend lineally with the centerline of the tower to engage the receiver of the head stand and lift the tower and associated wires lineally with the centerline of the tower from the first dimension to the second dimension.

17. The tower lifting system as claimed in claim 16, further comprising a vertical extension section configured to be disposed between the tower and the ground surface when the lift has increased the distance of the wires from the first dimension to the second dimension.

18. The tower lifting system as claimed in claim 17, wherein the vertical extension is secured to corners of the tower at a first end and to the ground surface at a second end.

19. The tower lifting system as claimed in claim 16, further comprising:

a plurality of outriggers positioned between the hydraulic jack and the portable transport device;

a positioning level indicator and a leveling system for orientating the hydraulic jack with respect to the receiver; and a head stand locking system for securing the uppermost telescoping section of the hydraulic jack to the receiver, the section configured to be received within the receiver of the head stand.

* * * * *